US011772375B2

(12) United States Patent
Kondo et al.

(10) Patent No.: US 11,772,375 B2
(45) Date of Patent: Oct. 3, 2023

(54) LIQUID EJECTING APPARATUS, HEAD DRIVING CIRCUIT, AND LIQUID EJECTING HEAD

(71) Applicant: Seiko Epson Corporation, Tokyo (JP)

(72) Inventors: Yoichiro Kondo, Chino (JP); Toru Kashimura, Shiojiri (JP); Asami Okamoto, Matsumoto (JP)

(73) Assignee: SEIKO EPSON CORPORATION

( * ) Notice: Subject to any disclaimer, the term of this patent is extended or adjusted under 35 U.S.C. 154(b) by 41 days.

(21) Appl. No.: 17/460,425

(22) Filed: Aug. 30, 2021

(65) Prior Publication Data

US 2022/0063266 A1 Mar. 3, 2022

(30) Foreign Application Priority Data

Aug. 31, 2020 (JP) ..... 2020-145248

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2/04596* (2013.01); *B41J 2/14201* (2013.01); *B41J 2002/14491* (2013.01)

(58) Field of Classification Search
CPC ..... B41J 2/04581
See application file for complete search history.

(56) References Cited

U.S. PATENT DOCUMENTS

| | | | |
|---|---|---|---|
| 6,190,009 | B1 | 2/2001 | Kitahara |
| 6,663,222 | B2 | 12/2003 | Verhoest et al. |
| 9,421,766 | B2 | 8/2016 | Owaku et al. |
| 10,752,009 | B2 | 8/2020 | Kudo et al. |
| 2008/0150986 | A1 | 6/2008 | Ikeda |
| 2011/0279606 | A1 | 11/2011 | Oguchi et al. |

(Continued)

FOREIGN PATENT DOCUMENTS

| | | | |
|---|---|---|---|
| EP | 3686013 | A2 | 7/2020 |
| JP | 2015-030181 | A | 2/2015 |
| JP | 2019-199054 | A | 11/2019 |

OTHER PUBLICATIONS

U.S. Appl. No. 17/335,226, filed Jun. 1, 2021, Hiroki Okui.

(Continued)

*Primary Examiner* — Shelby L Fidler
(74) *Attorney, Agent, or Firm* — Harness, Dickey & Pierce, P.L.C.

(57) ABSTRACT

A liquid ejecting apparatus includes a liquid ejecting head, a first drive signal, a second drive signal output circuit, a third drive signal output circuit that outputs a third drive signal, having a smaller voltage amplitude than voltage amplitudes of other drive signals, to drive the liquid ejecting head, and a first conductive component including a first conductive section that electrically couples the liquid ejecting head to the first drive signal output circuit, a second conductive section that electrically couples the liquid ejecting head to the second drive signal output circuit, and a third conductive section that electrically couples the liquid ejecting head to the third drive signal output circuit. The first conductive section is positioned between the second conductive section and the third conductive section.

8 Claims, 17 Drawing Sheets

| CABLE 15a | | COUPLING SECTION | COUPLER 330 | SIGNAL |
|---|---|---|---|---|
| WIRING | TERMINAL | | | |
| 153a-1 | 152a-1 | 180a-1 | 343-1 | GND |
| 153a-2 | 152a-2 | 180a-2 | 343-2 | COMA1 |
| 153a-3 | 152a-3 | 180a-3 | 343-3 | COMB1 |
| 153a-4 | 152a-4 | 180a-4 | 343-4 | VBS1 |
| 153a-5 | 152a-5 | 180a-5 | 343-5 | COMC1 |
| 153a-6 | 152a-6 | 180a-6 | 343-6 | COMA2 |
| 153a-7 | 152a-7 | 180a-7 | 343-7 | COMB2 |
| 153a-8 | 152a-8 | 180a-8 | 343-8 | VBS2 |
| 153a-9 | 152a-9 | 180a-9 | 343-9 | COMC2 |
| 153a-10 | 152a-10 | 180a-10 | 343-10 | COMA3 |
| 153a-11 | 152a-11 | 180a-11 | 343-11 | COMB3 |
| 153a-12 | 152a-12 | 180a-12 | 343-12 | VBS3 |
| 153a-13 | 152a-13 | 180a-13 | 343-13 | COMC3 |
| 153a-14 | 152a-14 | 180a-14 | 343-14 | COMA4 |
| 153a-15 | 152a-15 | 180a-15 | 343-15 | COMB4 |
| 153a-16 | 152a-16 | 180a-16 | 343-16 | VBS4 |
| 153a-17 | 152a-17 | 180a-17 | 343-17 | COMC4 |
| 153a-18 | 152a-18 | 180a-18 | 343-18 | COMA5 |
| 153a-19 | 152a-19 | 180a-19 | 343-19 | COMB5 |
| 153a-20 | 152a-20 | 180a-20 | 343-20 | VBS5 |
| 153a-21 | 152a-21 | 180a-21 | 343-21 | COMC5 |
| 153a-22 | 152a-22 | 180a-22 | 343-22 | COMA6 |
| 153a-23 | 152a-23 | 180a-23 | 343-23 | COMB6 |
| 153a-24 | 152a-24 | 180a-24 | 343-24 | VBS6 |
| 153a-25 | 152a-25 | 180a-25 | 343-25 | COMC6 |
| 153a-26 | 152a-26 | 180a-26 | 343-26 | GND |
| 153a-27 | 152a-27 | 180a-27 | 343-27 | DATA1+ |
| 153a-28 | 152a-28 | 180a-28 | 343-28 | DATA1− |

(56) References Cited

U.S. PATENT DOCUMENTS

| | | | | |
|---|---|---|---|---|
| 2016/0114592 | A1 | 4/2016 | Ishii et al. | |
| 2017/0120584 | A1* | 5/2017 | Kondo | B41J 2/04596 |
| 2017/0282553 | A1 | 10/2017 | Hayashi et al. | |
| 2017/0282562 | A1 | 10/2017 | Mizuno et al. | |
| 2018/0009218 | A1* | 1/2018 | Tamura | B41J 2/04596 |
| 2018/0178511 | A1 | 6/2018 | Kashimura | |
| 2018/0297369 | A1 | 10/2018 | Emi | |
| 2019/0061346 | A1* | 2/2019 | Chikamoto | B41J 2/14233 |
| 2019/0232646 | A1* | 8/2019 | Ito | B41J 2/04541 |
| 2019/0263112 | A1* | 8/2019 | Shinkawa | B41J 2/0451 |
| 2019/0351679 | A1 | 11/2019 | Ito | |
| 2020/0031134 | A1 | 1/2020 | Mizuno | |
| 2020/0079086 | A1 | 3/2020 | Asai et al. | |
| 2020/0198330 | A1* | 6/2020 | Uematsu | B41J 2/04596 |

OTHER PUBLICATIONS

U.S. Appl. No. 17/303,416, filed May 28, 2021, Hiroaki Okui.
U.S. Appl. No. 17/304,040, filed Jun. 14, 2021, Eiichiro Watanabe Hiroki Kobayashi.
U.S. Appl. No. 17/346,349, filed Jun. 14, 2021, Eiichiro Watanabe.
U.S. Appl. No. 17/385,541, filed Jul. 26, 2021, Eiichiro Watanabe.
U.S. Appl. No. 17/355,230, filed Jun. 1, 2021, Hiroaki Okui Eiichiro Watanabe Shun Katsuie.

* cited by examiner

| [SIH, SIL] | [1, 1] LD | [1, 0] SD | [0, 1] ND | [0, 0] BSD |
|---|---|---|---|---|
| S1 | H | L | L | L |
| S2 | L | H | L | L |
| S3 | L | L | L | H |

FIG. 15

| CABLE 15a | | COUPLING SECTION | COUPLER 330 | SIGNAL |
|---|---|---|---|---|
| WIRING | TERMINAL | | | |
| 153a-1 | 152a-1 | 180a-1 | 343-1 | GND |
| 153a-2 | 152a-2 | 180a-2 | 343-2 | COMA1 |
| 153a-3 | 152a-3 | 180a-3 | 343-3 | COMB1 |
| 153a-4 | 152a-4 | 180a-4 | 343-4 | VBS1 |
| 153a-5 | 152a-5 | 180a-5 | 343-5 | COMC1 |
| 153a-6 | 152a-6 | 180a-6 | 343-6 | COMA2 |
| 153a-7 | 152a-7 | 180a-7 | 343-7 | COMB2 |
| 153a-8 | 152a-8 | 180a-8 | 343-8 | VBS2 |
| 153a-9 | 152a-9 | 180a-9 | 343-9 | COMC2 |
| 153a-10 | 152a-10 | 180a-10 | 343-10 | COMA3 |
| 153a-11 | 152a-11 | 180a-11 | 343-11 | COMB3 |
| 153a-12 | 152a-12 | 180a-12 | 343-12 | VBS3 |
| 153a-13 | 152a-13 | 180a-13 | 343-13 | COMC3 |
| 153a-14 | 152a-14 | 180a-14 | 343-14 | COMA4 |
| 153a-15 | 152a-15 | 180a-15 | 343-15 | COMB4 |
| 153a-16 | 152a-16 | 180a-16 | 343-16 | VBS4 |
| 153a-17 | 152a-17 | 180a-17 | 343-17 | COMC4 |
| 153a-18 | 152a-18 | 180a-18 | 343-18 | COMA5 |
| 153a-19 | 152a-19 | 180a-19 | 343-19 | COMB5 |
| 153a-20 | 152a-20 | 180a-20 | 343-20 | VBS5 |
| 153a-21 | 152a-21 | 180a-21 | 343-21 | COMC5 |
| 153a-22 | 152a-22 | 180a-22 | 343-22 | COMA6 |
| 153a-23 | 152a-23 | 180a-23 | 343-23 | COMB6 |
| 153a-24 | 152a-24 | 180a-24 | 343-24 | VBS6 |
| 153a-25 | 152a-25 | 180a-25 | 343-25 | COMC6 |
| 153a-26 | 152a-26 | 180a-26 | 343-26 | GND |
| 153a-27 | 152a-27 | 180a-27 | 343-27 | DATA1+ |
| 153a-28 | 152a-28 | 180a-28 | 343-28 | DATA1- |

FIG. 16

| CABLE 15b | | COUPLING SECTION | COUPLER 331 | SIGNAL |
|---|---|---|---|---|
| WIRING | TERMINAL | | | |
| 153b-p | 152b-p | 180b-p | 353-p | GND |
| 153b-(p-1) | 152b-(p-1) | 180b-(p-1) | 353-(p-1) | COMA1 |
| 153b-(p-2) | 152b-(p-2) | 180b-(p-2) | 353-(p-2) | COMB1 |
| 153b-(p-3) | 152b-(p-3) | 180b-(p-3) | 353-(p-3) | VBS1 |
| 153b-(p-4) | 152b-(p-4) | 180b-(p-4) | 353-(p-4) | COMC1 |
| 153b-(p-5) | 152b-(p-5) | 180b-(p-5) | 353-(p-5) | COMA2 |
| 153b-(p-6) | 152b-(p-6) | 180b-(p-6) | 353-(p-6) | COMB2 |
| 153b-(p-7) | 152b-(p-7) | 180b-(p-7) | 353-(p-7) | VBS2 |
| 153b-(p-8) | 152b-(p-8) | 180b-(p-8) | 353-(p-8) | COMC2 |
| 153b-(p-9) | 152b-(p-9) | 180b-(p-9) | 353-(p-9) | COMA3 |
| 153b-(p-10) | 152b-(p-10) | 180b-(p-10) | 353-(p-10) | COMB3 |
| 153b-(p-11) | 152b-(p-11) | 180b-(p-11) | 353-(p-11) | VBS3 |
| 153b-(p-12) | 152b-(p-12) | 180b-(p-12) | 353-(p-12) | COMC3 |
| 153b-(p-13) | 152b-(p-13) | 180b-(p-13) | 353-(p-13) | COMA4 |
| 153b-(p-14) | 152b-(p-14) | 180b-(p-14) | 353-(p-14) | COMB4 |
| 153b-(p-15) | 152b-(p-15) | 180b-(p-15) | 353-(p-15) | VBS4 |
| 153b-(p-16) | 152b-(p-16) | 180b-(p-16) | 353-(p-16) | COMC4 |
| 153b-(p-17) | 152b-(p-17) | 180b-(p-17) | 353-(p-17) | COMA5 |
| 153b-(p-18) | 152b-(p-18) | 180b-(p-18) | 353-(p-18) | COMB5 |
| 153b-(p-19) | 152b-(p-19) | 180b-(p-19) | 353-(p-19) | VBS5 |
| 153b-(p-20) | 152b-(p-20) | 180b-(p-20) | 353-(p-20) | COMC5 |
| 153b-(p-21) | 152b-(p-21) | 180b-(p-21) | 353-(p-21) | COMA6 |
| 153b-(p-22) | 152b-(p-22) | 180b-(p-22) | 353-(p-22) | COMB6 |
| 153b-(p-23) | 152b-(p-23) | 180b-(p-23) | 353-(p-23) | VBS6 |
| 153b-(p-24) | 152b-(p-24) | 180b-(p-24) | 353-(p-24) | COMC6 |
| 153b-(p-25) | 152b-(p-25) | 180b-(p-25) | 353-(p-25) | GND |
| 153b-(p-26) | 152b-(p-26) | 180b-(p-26) | 353-(p-26) | DATA2+ |
| 153b-(p-27) | 152b-(p-27) | 180b-(p-27) | 353-(p-27) | DATA2- |

FIG. 17

| CABLE 15a | | COUPLING SECTION | COUPLER 330 | SIGNAL |
|---|---|---|---|---|
| WIRING | TERMINAL | | | |
| 153a-1 | 152a-1 | 180a-1 | 343-1 | GND |
| 153a-2 | 152a-2 | 180a-2 | 343-2 | COMA1 |
| 153a-3 | 152a-3 | 180a-3 | 343-3 | VBS1 |
| 153a-4 | 152a-4 | 180a-4 | 343-4 | COMB1 |
| 153a-5 | 152a-5 | 180a-5 | 343-5 | COMC1 |
| 153a-6 | 152a-6 | 180a-6 | 343-6 | COMA2 |
| 153a-7 | 152a-7 | 180a-7 | 343-7 | VBS2 |

FIG. 18

| CABLE 15b | | COUPLING SECTION | COUPLER 331 | SIGNAL |
|---|---|---|---|---|
| WIRING | TERMINAL | | | |
| 153b-p | 152b-p | 180b-p | 353-p | GND |
| 153b-(p-1) | 152b-(p-1) | 180b-(p-1) | 353-(p-1) | COMA1 |
| 153b-(p-2) | 152b-(p-2) | 180b-(p-2) | 353-(p-2) | VBS1 |
| 153b-(p-3) | 152b-(p-3) | 180b-(p-3) | 353-(p-3) | COMB1 |
| 153b-(p-4) | 152b-(p-4) | 180b-(p-4) | 353-(p-4) | COMC1 |
| 153b-(p-5) | 152b-(p-5) | 180b-(p-5) | 353-(p-5) | COMA2 |
| 153b-(p-6) | 152b-(p-6) | 180b-(p-6) | 353-(p-6) | VBS2 |

FIG. 19

| CABLE 15a | | COUPLING SECTION | COUPLER 330 | SIGNAL |
|---|---|---|---|---|
| WIRING | TERMINAL | | | |
| 153a-1 | 152a-1 | 180a-1 | 343-1 | GND |
| 153a-2 | 152a-2 | 180a-2 | 343-2 | COMA1 |
| 153a-3 | 152a-3 | 180a-3 | 343-3 | VBS1 |
| 153a-4 | 152a-4 | 180a-4 | 343-4 | COMB1 |
| 153a-5 | 152a-5 | 180a-5 | 343-5 | GND |
| 153a-6 | 152a-6 | 180a-6 | 343-6 | COMC1 |
| 153a-7 | 152a-7 | 180a-7 | 343-7 | GND |
| 153a-8 | 152a-8 | 180a-8 | 343-8 | COMA2 |
| 153a-9 | 152a-9 | 180a-9 | 343-9 | VBS2 |

FIG. 20

| CABLE 15b | | COUPLING SECTION | COUPLER 331 | SIGNAL |
|---|---|---|---|---|
| WIRING | TERMINAL | | | |
| 153b-p | 152b-p | 180b-p | 353-p | GND |
| 153b-(p-1) | 152b-(p-1) | 180b-(p-1) | 353-(p-1) | COMA1 |
| 153b-(p-2) | 152b-(p-2) | 180b-(p-2) | 353-(p-2) | VBS1 |
| 153b-(p-3) | 152b-(p-3) | 180b-(p-3) | 353-(p-3) | COMB1 |
| 153b-(p-4) | 152b-(p-4) | 180b-(p-4) | 353-(p-4) | GND |
| 153b-(p-5) | 152b-(p-5) | 180b-(p-5) | 353-(p-5) | GND |
| 153b-(p-6) | 152b-(p-6) | 180b-(p-6) | 353-(p-6) | GND |
| 153b-(p-7) | 152b-(p-7) | 180b-(p-7) | 353-(p-7) | COMA2 |
| 153b-(p-8) | 152b-(p-8) | 180b-(p-8) | 353-(p-8) | VBS2 |

LIQUID EJECTING APPARATUS, HEAD DRIVING CIRCUIT, AND LIQUID EJECTING HEAD

The present application is based on, and claims priority from JP Application Serial Number 2020-145248, filed Aug. 31, 2020, the disclosure of which is hereby incorporated by reference herein in its entirety.

BACKGROUND

1. Technical Field

The present disclosure relates to a liquid ejecting apparatus, a head driving circuit, and a liquid ejecting head.

2. Related Art

As a liquid ejecting apparatus such as an ink jet printer, a so-called piezoelectric liquid ejecting apparatus is known, which uses a drive signal to drive a piezoelectric element included in a print head and ejects a liquid such as ink stored in a cavity from a nozzle by the driving of the piezoelectric element to form a character or an image on a medium.

For example, JP-A-2019-199054 discloses a technique for reducing a variation in an inductance component that occurs between wirings included in a flexible flat cable (FFC) that propagates two types of drive signals COMA and COMB to drive piezoelectric elements included in a liquid ejecting head included in a liquid ejecting apparatus that ejects ink from the liquid ejecting head by driving the piezoelectric elements using the two types of drive signals COMA and COMB.

In recent years, a speed until the completion of the ejection of a liquid to a target object in a liquid ejecting apparatus, for example, a printing speed of an ink jet printer is requested to be improved. As one of methods for improving such a speed, a technique is known, which is provided for the liquid ejecting apparatus described in JP-A-2019-199054 and is to simultaneously transfer a plurality of drive signals including different waveforms and apply a predetermined drive signal to a driving element based on a necessary ejection amount.

However, when the number of types of drive signals to be transferred is increased, the accuracy of transferring the drive signals may be reduced due to an effect of mutual interference between the transferred drive signals, noise of the transferred drive signals, or the like. Therefore, to improve the speed until the completion of the ejection of a liquid to a target object, the liquid ejecting apparatus described in JP-A-2019-199054 may be improved by reducing a possibility that the accuracy of transferring the multiple types of drive signals may be reduced.

SUMMARY

According to an aspect of the present disclosure, a liquid ejecting apparatus includes a liquid ejecting head that includes a piezoelectric element and ejects a liquid, a first drive signal output circuit that outputs a first drive signal to drive the piezoelectric element so as to eject the liquid from the liquid ejecting head, a second drive signal output circuit that outputs a second drive signal to drive the piezoelectric element so as to eject the liquid from the liquid ejecting head, a third drive signal output circuit that outputs a third drive signal, having a smaller voltage amplitude than voltage amplitudes of the first and second drive signals, to drive the piezoelectric element so as not to eject the liquid from the liquid ejecting head, and a first conductive component including a first conductive section that electrically couples the liquid ejecting head to the first drive signal output circuit, a second conductive section that electrically couples the liquid ejecting head to the second drive signal output circuit, and a third conductive section that electrically couples the liquid ejecting head to the third drive signal output circuit, and the first conductive section is positioned between the second conductive section and the third conductive section.

According to another aspect of the present disclosure, a head driving circuit that drives a piezoelectric element included in a liquid ejecting head that ejects a liquid includes a first drive signal output circuit that outputs a first drive signal to drive the piezoelectric element so as to eject the liquid from the liquid ejecting head, a second drive signal output circuit that outputs a second drive signal to drive the piezoelectric element so as to eject the liquid from the liquid ejecting head, a third drive signal output circuit that outputs a third drive signal, having a smaller voltage amplitude than voltage amplitudes of the first and second drive signals, to drive the piezoelectric element so as not to eject the liquid from the liquid ejecting head, and a first cable including a first wiring that is electrically coupled to the first drive signal output circuit and propagates the first drive signal, a second wiring that is electrically coupled to the second drive signal output circuit and propagates the second drive signal, and a third wiring that is electrically coupled to the third drive signal output circuit and propagates the third drive signal, and the first wiring is positioned between the second wiring and the third wiring.

According to still another aspect of the present disclosure, a liquid ejecting head includes a piezoelectric element, a nozzle that ejects a liquid by driving of the piezoelectric element, and a first coupler to which a first wiring through which a first drive signal to drive the piezoelectric element so as to eject the liquid propagates, a second wiring through which a second drive signal to drive the piezoelectric element so as to eject the liquid propagates, and a third wiring through which a third drive signal, having a smaller voltage amplitude than voltage amplitudes of the first and second drive signals, to drive the piezoelectric element so as not to eject the liquid propagates are attached, and a first coupling section in which the first coupler is electrically coupled to the first wiring is positioned between a second coupling section in which the first coupler is electrically coupled to the second wiring and a third coupling section in which the first coupler is electrically coupled to the third wiring.

BRIEF DESCRIPTION OF THE DRAWINGS

FIG. 15 is a diagram illustrating an example of the allocation of signals that propagate through wirings, terminals of the coupler, and coupling sections in which terminals of the cable are coupled to the terminals of the coupler.

FIG. 16 is a diagram illustrating an example of the allocation of signals that propagate through wirings, terminals of the coupler, and coupling sections in which terminals of the cable are coupled to the terminals of the coupler.

FIG. 17 is a diagram illustrating an example of the allocation of signals that propagate through wirings, terminals of a coupler, and coupling sections in which terminals of a cable are coupled to the terminals of the coupler according to a second embodiment.

FIG. 18 is a diagram illustrating an example of the allocation of signals that propagate through wirings, terminals of a coupler, and coupling sections in which terminals of a cable are coupled to the terminals of the coupler according to the second embodiment.

FIG. 19 is a diagram illustrating an example of the allocation of signals that propagate through wirings, terminals of a coupler, and coupling sections in which terminals of a cable are coupled to the terminals of the coupler according to a third embodiment.

FIG. 20 is a diagram illustrating an example of the allocation of signals that propagate through wirings, terminals of a coupler, and coupling sections in which terminals of a cable are coupled to the terminals of the coupler according to the third embodiment.

DESCRIPTION OF EXEMPLARY EMBODIMENTS

Hereinafter, embodiments of the present disclosure are described using the drawings. The drawings are for convenience of explanation. The embodiments described below do not unduly limit details described in the appended claims. In addition, not all configurations described in the embodiment are necessarily essential.

1. First Embodiment

1.1 Configuration of Liquid Ejecting Apparatus

Figure 1:
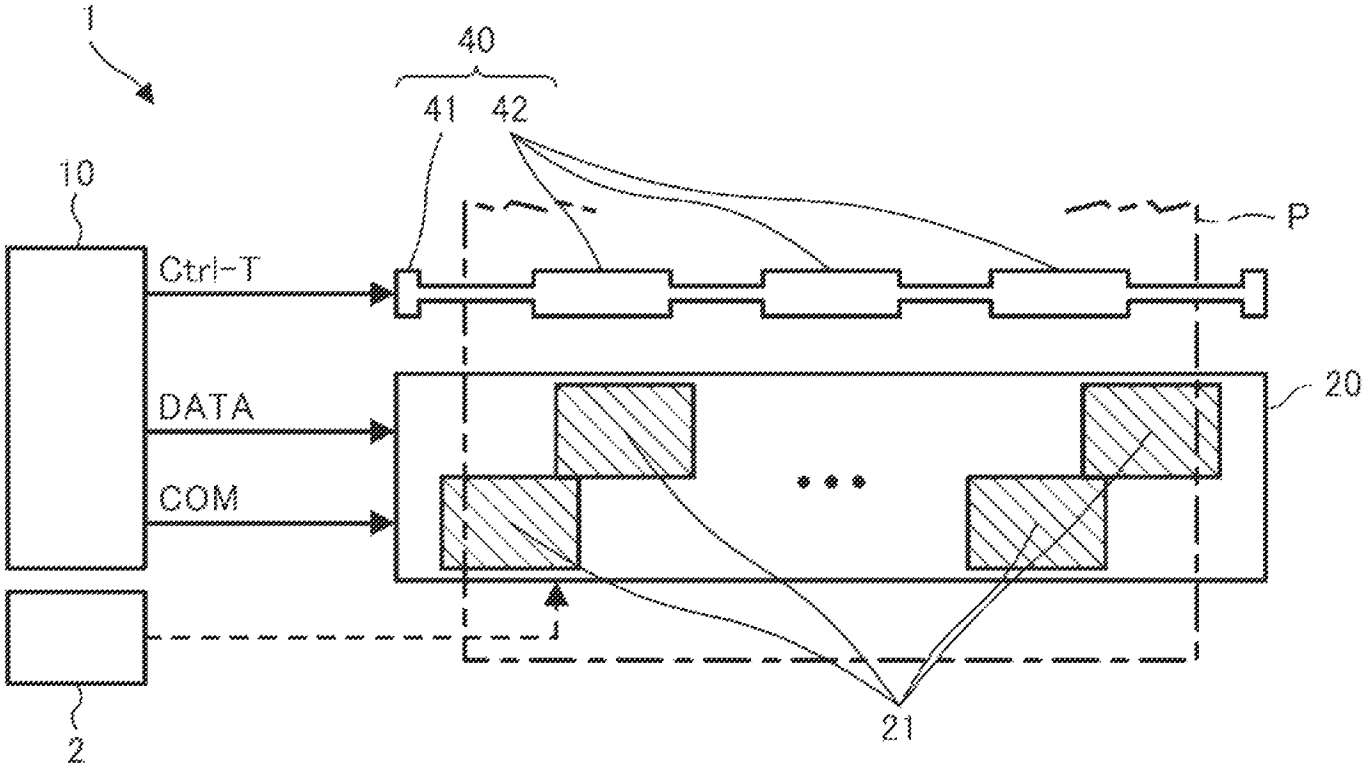
FIG. 1 is a diagram illustrating a schematic configuration of a liquid ejecting apparatus.

FIG. 1 is a diagram illustrating a schematic configuration of a liquid ejecting apparatus 1. As illustrated in FIG. 1, the liquid ejecting apparatus 1 according to a first embodiment is an ink jet printer that ejects, at desired time, ink onto a medium P transported by a transport unit 40 to form a desired image on the medium P. In the following description, a width direction of the transported medium P is referred to as main scan direction in some cases and a direction in which the medium P is transported is referred to as transport direction in some cases.

As illustrated in FIG. 1, the liquid ejecting apparatus 1 includes a liquid container 2, a control unit 10, a head unit 20, and the transport unit 40.

The liquid container 2 stores ink as an example of a liquid to be supplied to the head unit 20. Specifically, the ink of multiple types that is to be ejected onto the medium P are stored in the liquid container 2. Examples of colors of the ink stored in the liquid container 2 are black, cyan, magenta, yellow, red, and gray. As the liquid container 2, an ink cartridge, a bag-shaped ink pack formed of a flexible film, an ink tank that can be refilled with ink, or the like can be used.

The control unit 10 includes a processing circuit such as a central processing unit (CPU) or a field programmable gate array (FPGA) and a storage circuit such as a semiconductor memory. The control unit 10 outputs a control signal to control each of components of the liquid ejecting apparatus 1.

The head unit 20 includes a plurality of liquid ejecting heads 21. In the head unit 20, the plurality of liquid ejecting heads 21 are arranged side by side in the main scan direction in a staggered manner, while a length of a region in which the liquid ejecting heads 21 are arranged in the main scan direction is equal to or larger than the width of the medium P. A data signal DATA to control an operation of each of the liquid ejecting heads 21 and a drive signal COM to drive each of the liquid ejecting heads 21 to cause each of the liquid ejecting heads 21 to eject the ink are input from the control unit 10 to each of the liquid ejecting heads 21 included in the head unit 20. In addition, the ink stored in the liquid container 2 is supplied to each of the liquid ejecting heads 21 through tubes not illustrated or the like. Each of the liquid ejecting heads 21 ejects the ink supplied from the liquid container 2 based on the input data signal DATA and the input drive signal COM.

The transport unit 40 includes a transport motor 41 and a transport roller 42. The transport motor 41 operates based on a transport control signal Ctrl-T input from the control unit 10.

The transport roller 42 is rotationally driven by the operation of the transport motor 41. The medium P is transported by the rotational driving of the transport roller 42 in the transport direction.

In the liquid ejecting apparatus 1 configured as described above, the control unit 10 coordinates with the transport of the medium P by the transport unit 40 to cause the plurality of liquid ejecting heads 21 to eject the ink in such a manner that the ejected ink lands at a desired position on the medium P to form a desired image on the medium P.

Figure 2A:
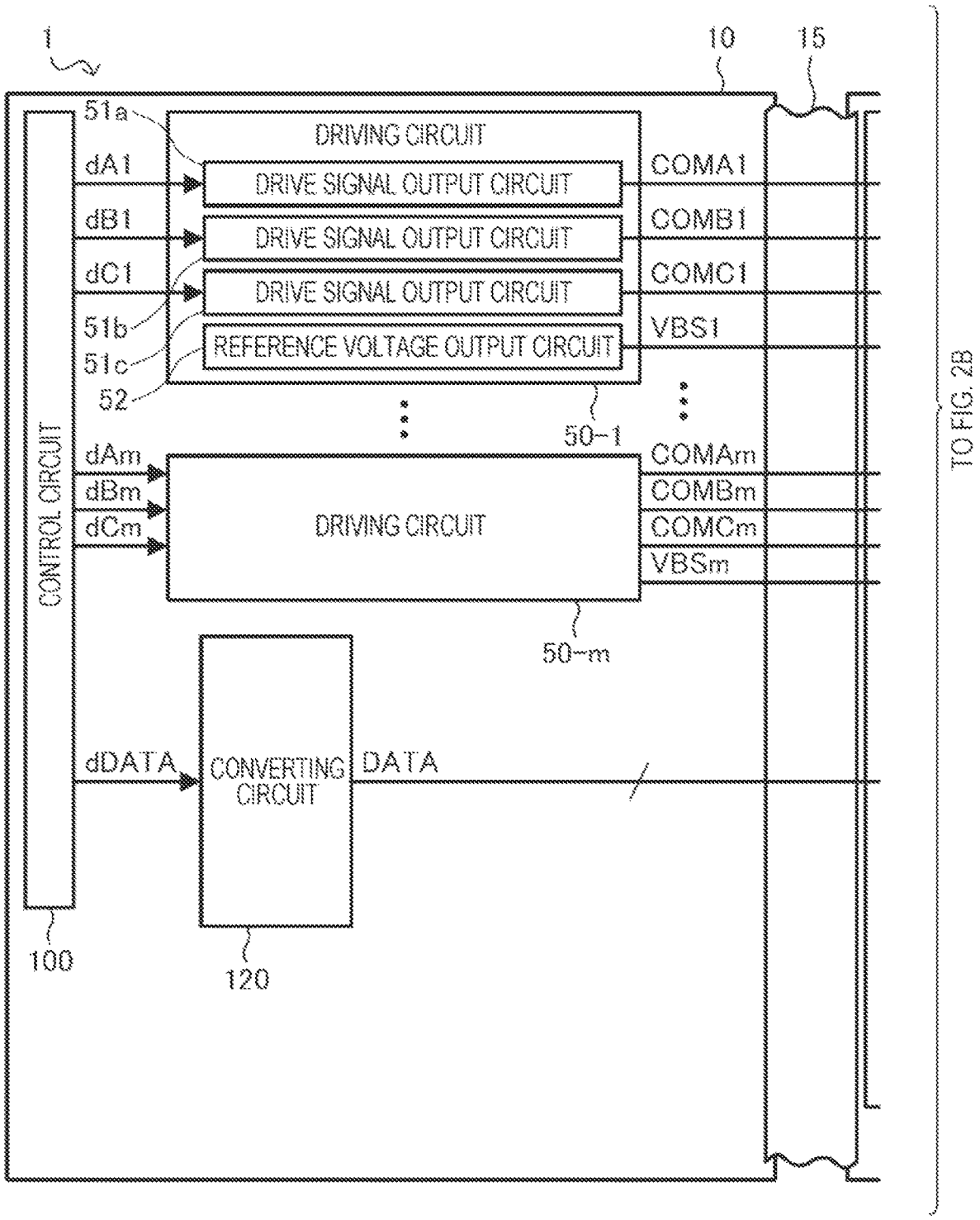
FIGS. 2A and 2B are diagrams illustrating a functional configuration of a control head and a functional configuration of a head unit.
Figure 2B:
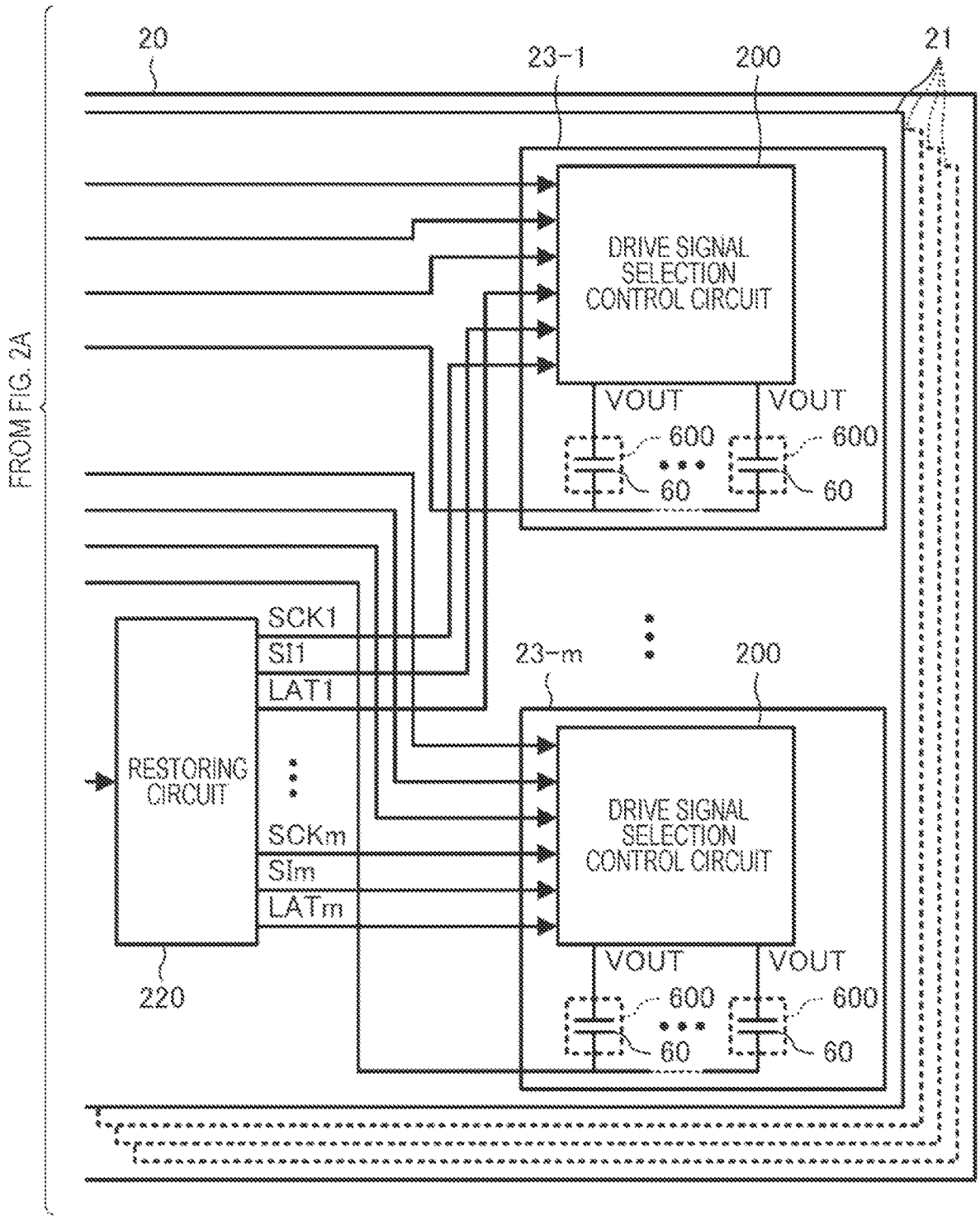

A specific example of the control of the head unit 20 by the control unit 10 is described below. FIGS. 2A and 2B are diagrams illustrating a functional configuration of the control unit 10 and a functional configuration of the head unit 20. As illustrated in FIG. 2A, the control unit 10 includes a control circuit 100, driving circuits 50-1 to **50-*m*, and a converting circuit 120. The head unit 20 includes the plurality of liquid ejecting heads 21. The control unit 10 is coupled to and able to communicate with each of the liquid ejecting heads 21 included in the head unit 20 through one or multiple cables 15**.

The liquid ejecting heads 21 have the same configuration. Therefore, FIG. 2B illustrates only a circuit configuration of one of the liquid ejecting heads 21 and does not illustrate circuit configurations of the other liquid ejecting heads 21. The following describes only an operation and functional configuration of one of the liquid ejecting heads 21. In the following description, descriptions of operations and functional configurations of the other liquid ejecting heads 21 are omitted or simplified.

The control circuit 100 includes an integrated circuit such as a CPU or an FPGA. Various signals such as image data are input to the control circuit 100 from a host computer not illustrated. The control circuit 100 outputs a control signal to control each of the components of the liquid ejecting apparatus 1 based on the input various signals such as image data.

The control circuit 100 generates a basic data signal dDATA as the basis of the data signal DATA based on the input various signals such as image data and outputs the generated basic data signal dDATA to the converting circuit 120. The converting circuit 120 converts the basic data signal dDATA into the data signal DATA that is a differential signal for low-voltage differential signaling (LVDS) or the like. The converting circuit 120 outputs the data signal DATA to the liquid ejecting heads 21. The converting circuit 120 may generate the data signal DATA by converting the basic data signal dDATA into a differential signal for one or more of various high-speed transfer techniques that exclude LVDS and are low-voltage positive emitter-coupled logic (LVPECL), current mode logic (CML), and the like. The converting circuit 120 may output the generated data signal DATA to the liquid ejecting heads 21. In addition, the converting circuit 120 may output a part of the signal as a single-ended signal.

The control circuit 100 outputs basic drive signals dA1, dB1, and dC1 to the driving circuit 50-1. The basic drive signal dA1 is input to a drive signal output circuit 51*a* included in the driving circuit 50-1. The drive signal output circuit 51*a* converts the input basic drive signal dA1 from a digital signal to an analog signal, performs class-D amplification on the analog signal to generate a drive signal COMA1, and outputs the generated drive signal COMA1 to the liquid ejecting heads 21. The basic drive signal dB1 is input to a drive signal output circuit 51*b* included in the driving circuit 50-1. The drive signal output circuit 51*b* converts the input basic drive signal dB1 from a digital signal to an analog signal, performs class-D amplification on the analog signal to generate a drive signal COMB1, and outputs the generated drive signal COMB1 to the liquid ejecting heads 21. The basic drive signal dC1 is input to a drive signal output circuit 51*c* included in the driving circuit 50-1. The drive signal output circuit 51*c* converts the input basic drive signal dC1 from a digital signal to an analog signal, performs class-D amplification on the analog signal to generate a drive signal COMC1, and outputs the generated drive signal COMC1 to the liquid ejecting heads 21.

It is sufficient if the drive signal output circuits 51*a*, 51*b*, and 51*c* generate the drive signals COMA1, COMB1, and COMC1 by performing the class-D amplification on waveforms defined by the input basic drive signals dA1, dB1, and dC1, respectively. The drive signal output circuits 51*a*, 51*b*, and 51*c* may be constituted by class-A amplifying circuits, class-B amplifying circuits, class-AB amplifying circuits, or the like, instead of class-D amplifying circuits or as well as the class-D amplifying circuits. It is sufficient if the basic drive signals dA1, dB1, and dC1 define the waveforms of the drive signals COMA1, COMB1, and COMC1, respectively. Therefore, the basic drive signals dA1, dB1, and dC1 are not limited to digital signals and may be analog signals.

The driving circuit 50-1 includes a reference voltage output circuit 52. The reference voltage output circuit 52 generates a reference voltage signal VBS1 at a fixed potential indicating a reference potential for piezoelectric elements 60 included in the liquid ejecting heads 21 by increasing or reducing a power supply voltage to be used by the liquid ejecting apparatus 1. The power supply voltage is not illustrated. The piezoelectric elements 60 are described later. The reference voltage output circuit 52 outputs the generated reference voltage signal VBS1 to the liquid ejecting heads 21. The reference voltage signal VBS1 output by the reference voltage output circuit 52 may be a signal at a fixed potential equal to a ground potential or may be a signal at a fixed potential of 5.5V or 6V.

The driving circuits 50-1 to 50-*m* are different only in that the drive circuits 50-1 to 50*m* receive different signals and output different signals. The driving circuits 50-1 to 50-*m* have the same configuration. That is, the driving circuit 50-*m* includes drive signal output circuits 51*a*, 51*b*, and 51*c* and a reference voltage output circuit 52. The driving circuit 50-*m* generates drive signals COMAm, COMBm, and COMCm based on basic drive signals dAm, dBm, and dCm input from the control circuit 100 and outputs the generated drive signals COMAm, COMBm, and COMCm to the liquid ejecting heads 21. The driving circuit 50-*m* generates a reference voltage signal VBSm and outputs the generated reference voltage signal VBSm to the liquid ejecting heads 21. Similarly, a driving circuit 50-*i* (i is any one of numbers 1 to m) includes drive signal output circuits 51*a*, 51*b*, and 51*c* and a reference voltage output circuit 52. The driving circuit 50-*i* generates drive signals COMAi, COMBi, and COMCi based on basic drive signals dAi, dBi, and dCi input from the control circuit 100 and outputs the generated drive signals COMAi, COMBi, and COMCi to the liquid ejecting heads 21. The driving circuit 50-*i* generates a reference voltage signal VBSi and outputs the generated reference voltage signal VBSi to the liquid ejecting heads 21.

Each of the liquid ejecting heads 21 included in the head unit 20 includes a restoring circuit 220 and ejection modules 23-1 to 23-*m*.

The restoring circuit 220 restores, to a single-ended signal, the data signal DATA that is the differential signal output by the control unit 10. Then, the restoring circuit 220 divides the single-ended signal into signals for the ejection modules 23-1 to 23-*m* and outputs the divided signals to the corresponding ejection modules 23-1 to 23-*m*.

Specifically, the restoring circuit 220 restores and divides the data signal DATA, which is the differential signal output by the control unit 20, to generate a clock signal SCK1, a print data signal SI1, and a latch signal LAT1 for the ejection module 23-1. Then, the restoring circuit 220 outputs the generated clock signal SCK1, the generated print data signal SI1, and the generated latch signal LAT1 to the ejection module 23-1. In addition, the restoring circuit 220 restores and divides the data signal DATA, which is the differential signal output by the control unit 20, to generate a clock signal SCKm, a print data signal SIm, and a latch signal LATm for the ejection module 23-*m*. Then, the restoring circuit 220 outputs the generated clock signal SCKm, the generated print data signal SIm, and the generated latch signal LATm to the ejection module 23-*m*. Similarly, the restoring circuit 220 restores and divides the data signal DATA, which is the differential signal output by the control unit 20, to generate a clock signal SCKi, a print data signal SIi, and a latch signal LATi for an ejection module 23-*i* (i is any one of numbers 1 to m). Then, the restoring circuit 220 outputs the generated clock signal SCKi, the generated print data signal SIi, and the generated latch signal LATi to the ejection module 23-*i*.

In the foregoing manner, the restoring circuit 220 restores and divides the data signal DATA, which is the differential signal output by the control unit 10, to generate clock signals SCK1 to SCKm, print data signals SI1 to SIm, and latch signals LAT1 to LATm for the ejection modules 23-1 to **23-*m* and outputs the clock signals SCK1 to SCKm, the print data signals SI1 to SIm, and the latch signals LAT1 to LATm to the corresponding ejection modules 23-1 to 23-*m***. That is, the data signal DATA includes the clock signals SCK1 to SCKm, the print data signals SI1 to SIm, and the latch signals LAT1 to LATm. The data signal DATA may be different differential signals that are a differential signal including the clock signals SCK1 to SCKm, a differential signal including the print data signals SI1 to SIm, and a differential signal including the latch signals LAT1 to LATm. Alternatively, the data signal DATA may be a single differential signal serially including the clock signals SCK1 to SCKm, the print data signals SI1 to SIm, and the latch signals LAT1 to LATm. Any one or more of the clock signals SCK1 to SCKm, the print data signals SI1 to SIm, and the latch signals LAT1 to LATm may be a single-ended signal.

The ejection module 23-1 includes a drive signal selection control circuit 200 and a plurality of ejectors 600 each having a piezoelectric element 60. The drive signals COMA1, COMB1, and COMC1, the reference voltage signal VBS1, the clock signal SCK1, the print data signal SI1, and the latch signal LAT1 are input to the ejection module 23-1. Among them, the drive signals COMA1, COMB1, and COMC1, the clock signal SCK1, the print data signal SI1, and the latch signal LAT1 are input to the drive signal selection control circuit 200 included in the ejection module 23-1. The drive signal selection control circuit 200 generates drive signals VOUT by selecting or not selecting each of the drive signals COMA1, COMB1, and COMC1 based on the input clock signal SCK1, the input print data signal SI1, and the input latch signal LAT1 and supplies the generated drive signals VOUT to first terminals of the piezoelectric elements 60 included in the corresponding ejectors 600. The reference voltage signal VBS1 is commonly supplied to second terminals of the piezoelectric elements 60 included in the plurality of ejectors 600. As a result, the piezoelectric elements 60 included in the plurality of ejectors 600 are driven based on potential differences between the drive signals VOUT supplied to the first terminals of the piezoelectric elements 60 and the reference voltage signal VBS1 supplied to the second terminals of the piezoelectric elements 60.

The ejection module **23-*m* includes a drive signal selection control circuit 200 and a plurality of ejectors 600 each including a piezoelectric element 60. The drive signals COMAm, COMBm, and COMCm, the reference voltage signal VBSm, the clock signal SCKm, the print data signal SIm, and the latch signal LATm are input to the ejection module 23-*m*. Among them, the drive signals COMAm, COMBm, and COMCm, the clock signal SCKm, the print data signal SIm, and the latch signal LATm are input to the drive signal selection control circuit 200 included in the ejection module 23-*m*. The drive signal selection control circuit 200 generates drive signals VOUT by selecting or not selecting each of the drive signals COMAm, COMBm, and COMCm based on the input clock signal SCKm, the input print data signal SIm, and the input latch signal LATm and supplies the generated drive signals VOUT to first terminals of the piezoelectric elements 60 included in the corresponding ejectors 600. The reference voltage signal VBSm is commonly supplied to second terminals of the piezoelectric elements 60 included in the ejectors 600. As a result, the piezoelectric elements 60 included in the ejectors 600 are driven based on potential differences between the drive signals VOUT supplied to the first terminals of the piezoelectric elements 60 and the reference voltage signal VBSm supplied to the second terminals of the piezoelectric elements 60**.

Similarly, an ejection module **23-*i* (i is any one of numbers 1 to m) includes a drive signal selection control circuit 200 and a plurality of ejectors 600 each including a piezoelectric element 60. The drive signals COMAi, COMBi, and COMCi, the reference voltage signal VBSi, the clock signal SCKi, the print data signal SIi, and the latch signal LATi are input to the ejection module 23-*i*. Among them, the drive signals COMAi, COMBi, and COMCi, the clock signal SCKi, the print data signal SIi, and the latch signal LATi are input to the drive signal selection control circuit 200 included in the ejection module 23-*i*. The drive signal selection control circuit 200 generates drive signals VOUT by selecting or not selecting each of the drive signals COMAi, COMBi, and COMCi based on the input clock signal SCKi, the input print data signal SIi, and the input latch signal LATi and supplies the generated drive signals VOUT to first terminals of the piezoelectric elements 60 included in the corresponding ejectors 600. The reference voltage signal VBSi is commonly supplied to second terminals of the piezoelectric elements 60 included in the ejectors 600. As a result, the piezoelectric elements 60 included in the ejectors 600 are driven based on potential differences between the drive signals VOUT supplied to the first terminals of the piezoelectric elements 60 and the reference voltage signal VBSi supplied to the second terminals of the piezoelectric elements 60**.

The ink in an amount corresponding to the driving of the piezoelectric elements 60 is ejected by the driving of the piezoelectric elements 60 included in the ejection modules 23-1 to **23-*m***.

As described above, the control unit 10 generates the data signal DATA that is the differential signal based on the various signals such as image data. The control unit 10 generates the drive signals COMA1 to COMAm, COMB1 to COMBm, and COMC1 to COMCm to drive the piezoelectric elements 60. The control unit 10 outputs the data signal DATA and the drive signals COMA1 to COMAm, COMB1 to COMBm, and COMC1 to COMCm to the liquid ejecting heads 21 through the cables 15. The liquid ejecting heads 21 are driven based on the input data signal DATA and the input drive signals COMA1 to COMAm, COMB1 to COMBm, and COMC1 to COMCm. A configuration including the control unit 10 and the cables 15 corresponds to a head driving circuit.

1.2 Functional Configurations of Drive Signal Selection Control Circuits Included in Liquid Ejecting Heads Next, operations of the drive signal selection control circuits 200 included in the ejection modules 23-1 to **23-*m* are described. The ejection modules 23-1 to 23-*m* are different only in that signals input to the ejection modules 23-1 to 23-*m* are different. The ejection modules 23-1 to 23-*m* have the same configuration. Therefore, in the following description, when the ejection modules 23-1 to 23-*m* do not need to be distinguished, the ejection modules 23-1 to 23-*m* are merely referred to as ejection modules 23. The drive signals COMA1 to COMAm that are input to the ejection modules 23 are referred to as drive signals COMA, the drive signals COMB1 to COMBm that are input to the ejection modules 23 are referred to as drive signals COMB, the drive signals COMC1 to COMCm that are input to the ejection modules 23 are referred to as drive signals COMC, the clock signals SCK1 to SCKm that are input to the ejection modules 23 are referred to as clock signals SCK, the print data signals SI1 to SIm that are input to the ejection modules 23 are referred to as print data signals SI, and the latch signals LAT1 to LATm that are input to the ejection modules 23** are referred to as latch signals LAT.

Before functional configurations of the drive signal selection control circuits 200 are described, an example of waveforms of the drive signals COMA, COMB, and COMC that are input to the drive signal selection control circuits 200 is described below.

Figure 3:
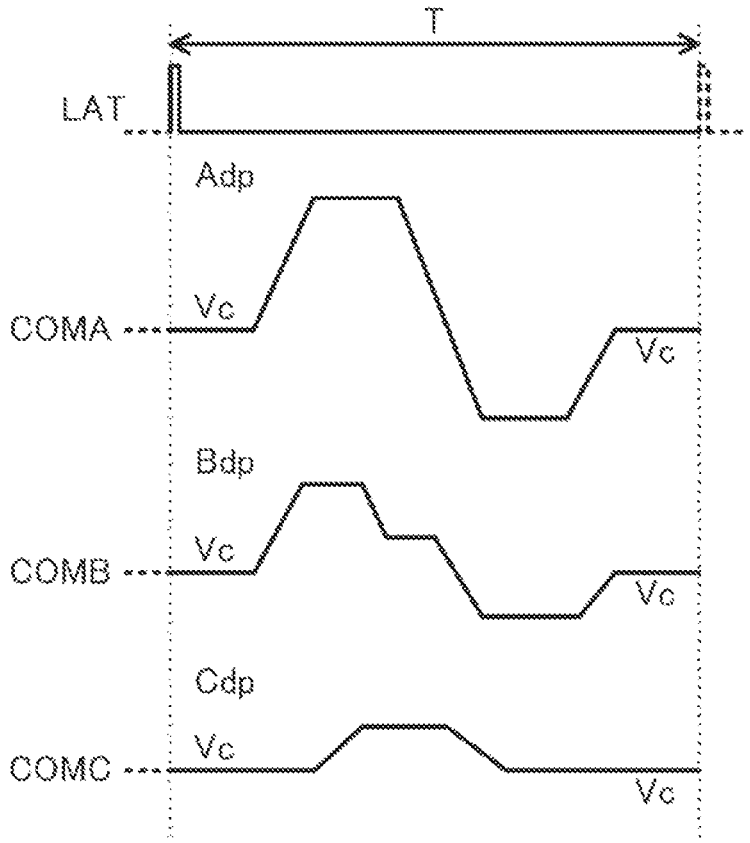
FIG. 3 is a diagram illustrating an example of waveforms of drive signals.

FIG. 3 is a diagram illustrating an example of the waveforms of the drive signals COMA, COMB, and COMC. As illustrated in FIG. 3, the drive signal COMA includes a trapezoidal waveform Adp in a cycle T from the rising of a latch signal LAT to the next rising of the latch signal LAT, the drive signal COMB includes a trapezoidal waveform Bdp in the cycle T, and the drive signal COMC includes a trapezoidal waveform Cdp in the cycle T.

When the trapezoidal waveform Adp is supplied to the first terminals of the piezoelectric elements 60, the ink in a large amount is ejected from the ejectors 600 corresponding to the piezoelectric elements 60. The trapezoidal waveform Bdp has a smaller voltage amplitude than that of the trapezoidal waveform Adp. When the trapezoidal waveform Bdp is supplied to the first terminals of the piezoelectric elements 60, the ink in a smaller amount than the large amount is ejected from the ejectors 600 corresponding to the piezoelectric elements 60. The trapezoidal waveform Cdp has a smaller voltage amplitude than those of the trapezoidal waveforms Adp and Bdp. When the trapezoidal waveform Cdp is supplied to the first terminals of the piezoelectric elements 60, the ink present near nozzle opening portions slightly vibrates in such a manner that the ink is not ejected from the ejectors 600 corresponding to the piezoelectric elements 60. This reduces a possibility that the viscosity of the ink present near the nozzle opening portions may increase.

Specifically, the drive signal COMA is a signal to drive the piezoelectric elements 60 so as to eject the ink from the liquid ejecting heads 21, the drive signal COMB is a signal to drive the piezoelectric elements 60 so as to eject the ink from the liquid ejecting heads 21, and the drive signal COMC is a signal to drive the piezoelectric elements 60 so as not to eject the ink from the liquid ejecting heads 21. The drive signal COMC has the smaller voltage amplitude than those of the drive signals COMA and COMB. The drive signal COMB is an example of a first drive signal. The drive signal output circuit 51*b* that outputs the drive signal COMB is an example of a first drive signal output circuit. The drive signal COMA is an example of a second drive signal. The drive signal output circuit 51*a* that outputs the drive signal COMA is an example of a second drive signal output circuit. The drive signal COMC is an example of a third drive signal. The drive signal output circuit 51*c* that outputs the drive signal COMC is an example of a third drive signal output circuit.

Voltages of the trapezoidal waveforms Adp, Bdp, and Cdp at the start time and end time of the trapezoidal waveforms Adp, Bdp, and Cdp are a common voltage Vc. That is, each of the trapezoidal waveforms Adp, Bdp, and Cdp starts at the voltage Vc and ends at the voltage Vc. Each of the drive signals COMA, COMB, and COMC may be a signal with two or more continuous trapezoidal waveforms in the cycle T. In this case, a signal that defines a boundary between the two or more trapezoidal waveforms and defines the timing of switching between the two or more trapezoidal waveforms may be input to the drive signal selection control circuits 200.

Figure 4:
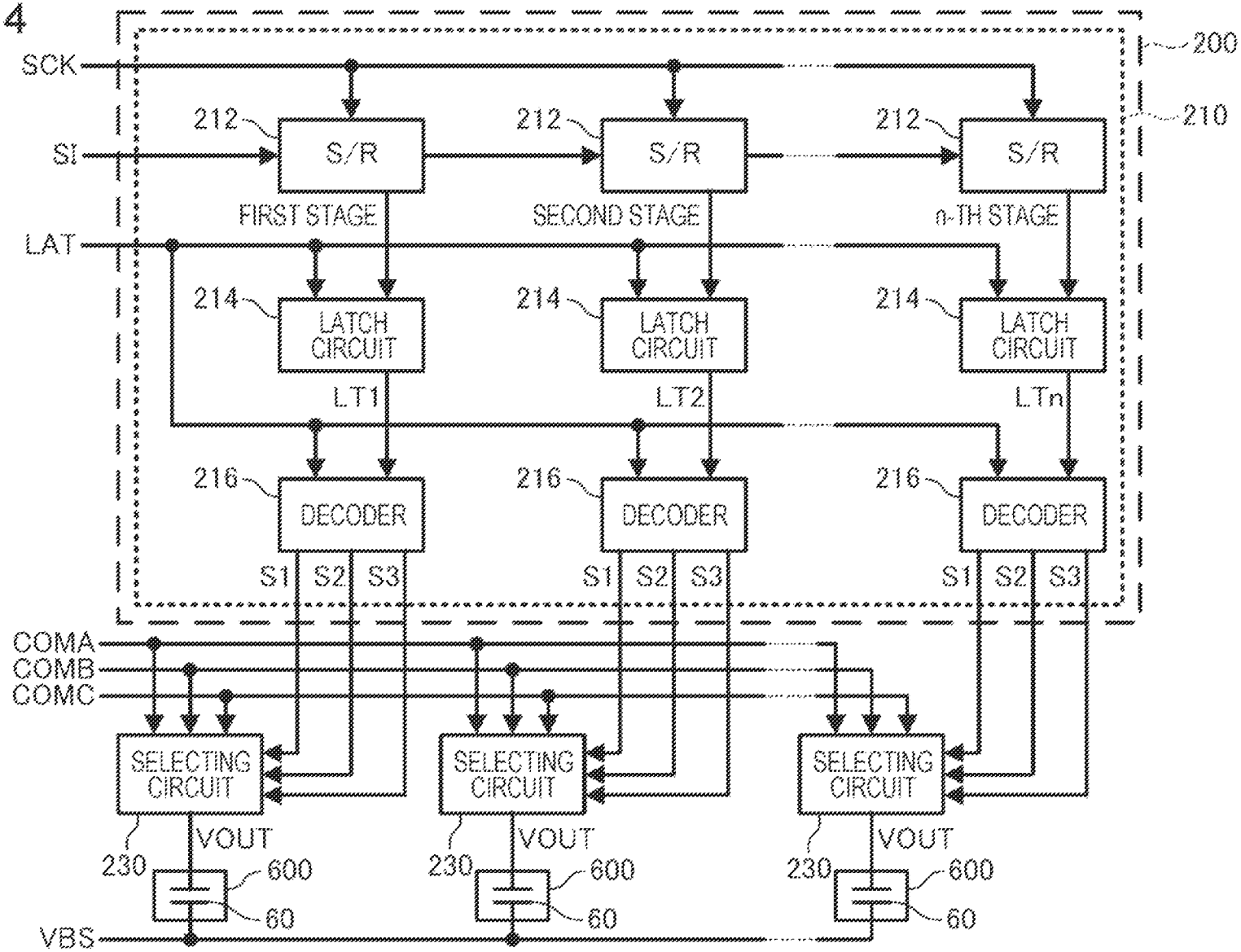
FIG. 4 is a diagram illustrating a functional configuration of a drive signal selection control circuit.

Next, a functional configuration and operations of each of the drive signal selection control circuits 200 are described using FIGS. 4 to 7. FIG. 4 is a diagram illustrating the functional configuration of the drive signal selection control circuit 200. As illustrated in FIG. 4, the drive signal selection control circuit 200 includes a selection control circuit 210 and a plurality of selecting circuits 230.

A print data signal SI, a latch signal LAT, and a clock signal SCK are input to the selection control circuit 210. Combinations of shift registers (S/Rs) 212, latch circuits 214, and decoders 216 are included in the selection control circuit 210 and correspond to a number n of ejectors 600. That is, the drive signal selection control circuit 200 includes the number n of combinations of the shift registers 212, the latch circuits 214, and the decoders 216, while the number n of combinations is equal to the total number of ejectors 600.

Specifically, the print data signal SI is synchronized with the clock signal SCK. The print data signal SI has a number 2n of bits in total and includes 2-bit print data items [SIH, SIL] to select any one of "large dot LD", "small dot SD", "non-ejection ND", and "slight vibration BSD" for each of the number n of ejectors 600. The print data signal SI is held in the shift registers 212 for each of the 2-bit print data items [SIH, SIL] corresponding to the ejectors 600 and included in the print data signal SI. Specifically, the shift registers 212 arranged at a number n of stages corresponding to the ejectors 600 are coupled in cascade to each other. The serially input print data signal SI is sequentially transferred to the subsequent stages in accordance with the clock signal SCK. To distinguish the shift registers 212, FIG. 4 illustrates the first, second, . . . , and n-th stages in order from the input side on which the print data signal SI is input.

The number n of latch circuits 214 collectively latch the 2-bit print data items [SIH, SIL] held in the number n of shift registers 212 when the latch signal LAT rises.

The number n of decoders 216 decode the 2-bit print data items [SIH, SIL] latched by the number n of latch circuits 214. Then, each of the decoders 216 outputs selection signals S1, S2, and S3 in each cycle T defined by the latch signal LAT.

Figures 5, 6:
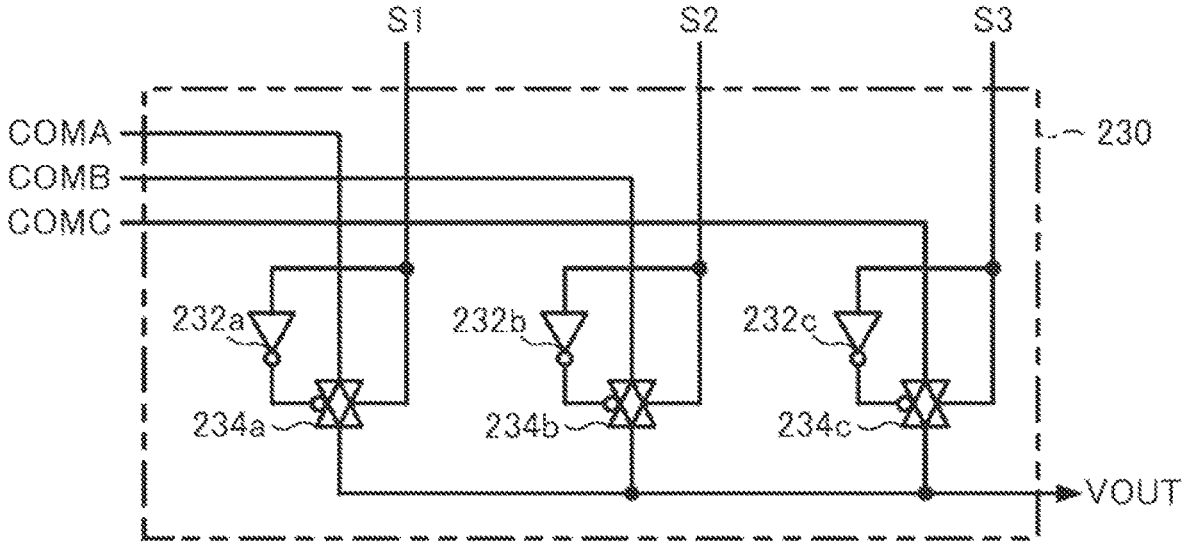
FIG. 5 is a diagram illustrating details of decoding by each of decoders.
FIG. 6 is a diagram illustrating a configuration of a selecting circuit corresponding to one ejector.

FIG. 5 is a diagram illustrating details of the decoding by each of the decoders 216. The decoder 216 outputs selection signals S1, S2, and S3 in accordance with the latched 2-bit print data item [SIH, SIL]. For example, when the 2-bit print data item [SIH, SIL] is [1, 0], the decoder 216 sets logical levels of the selection signals S1, S2, and S3 to L, H, and L and outputs the selection signals S1, S2, and S3 to the corresponding selecting circuit 230 in the cycle T.

The selecting circuits 230 are provided corresponding to the ejectors 600. That is, the number of selecting circuits 230 included in the drive signal selection control circuit 200 is the same as the total number n of corresponding ejectors 600.

FIG. 6 is a diagram illustrating a configuration of the selecting circuit 230 corresponding to one ejector 600. As illustrated in FIG. 6, the selecting circuit 230 includes inverters 232*a*, 232*b*, and 232*c* and transfer gates 234*a*, 234*b*, and 234*c*. The inverters 232*a*, 232*b*, and 232*c* are NOT circuits.

The selection signal SI is input to a positive control terminal of the transfer gate 234*a*. The positive control terminal is not marked with a circle in FIG. 6. In addition, the selection signal S1 is logically inverted by the inverter 232*a* and input to a negative control terminal of the transfer gate 234*a*. The negative control terminal is marked with a circle in FIG. 6. The drive signal COMA is supplied to an input terminal of the transfer gate 234*a*. When the input selection signal S1 is at an H level, the transfer gate 234*a* electrically couples the input terminal to an output terminal of the transfer gate 234*a* (or is turned on). When the input selection signal S1 is at a L level, the transfer gate 234*a* does not electrically couple the input terminal to the output terminal (or is turned off).

The selection signal S2 is input to a positive control terminal of the transfer gate 234*b*. The positive control terminal is not marked with a circle in FIG. 6. In addition, the selection signal S2 is logically inverted by the inverter 232*b* and input to a negative control terminal of the transfer gate 234*b*. The negative control terminal is marked with a circle in FIG. 6. The drive signal COMB is supplied to an input terminal of the transfer gate 234*b*. When the input selection signal S2 is at an H level, the transfer gate 234*b* electrically couples the input terminal to an output terminal of the transfer gate 234*b* (or is turned on). When the input selection signal S2 is at an L level, the transfer gate 234*b* does not electrically couple the input terminal to the output terminal (or is turned off).

The selection signal S3 is input to a positive control terminal of the transfer gate 234*c*. The positive control terminal is not marked with a circle in FIG. 6. In addition, the selection signal S3 is logically inverted by the inverter 232*c* and input to a negative control terminal of the transfer gate 234*c*. The negative control terminal is marked with a circle in FIG. 6. The drive signal COMC is supplied to an input terminal of the transfer gate 234*c*. When the input selection signal S3 is at an H level, the transfer gate 234*c* electrically couples the input terminal to an output terminal of the transfer gate 234*c* (or is turned on). When the input selection signal S3 is at an L level, the transfer gate 234*c* does not electrically couple the input terminal to the output terminal (or is turned off).

The output terminals of the transfer gates 234*a*, 234*b*, and 234*c* are commonly coupled to each other. Signals are output as a drive signal VOUT from the commonly coupled output terminals of the transfer gates 234*a*, 234*b*, and 234*c*.

Figure 7:
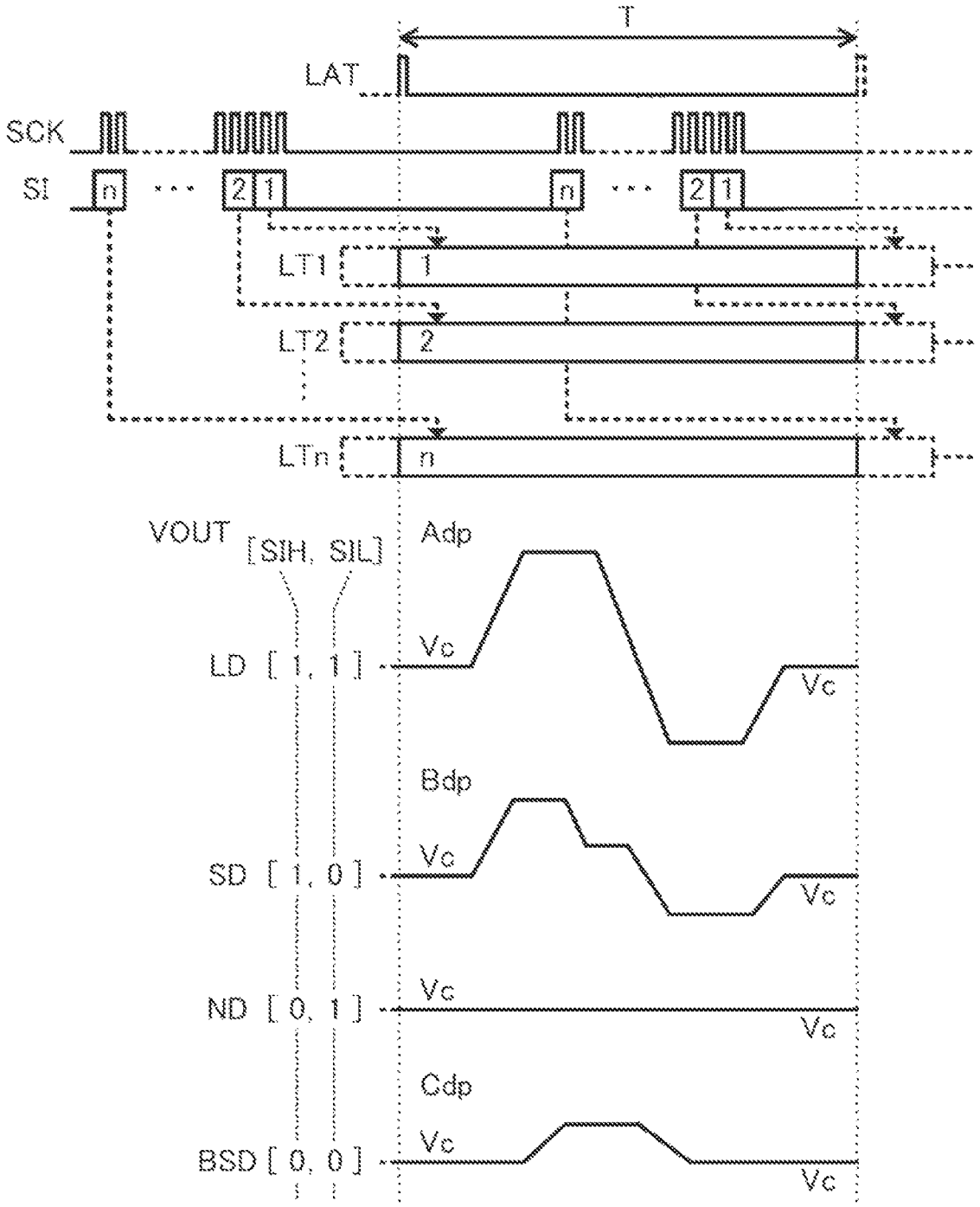
FIG. 7 is a diagram describing operations of the drive signal selection control circuit.

Operations of the drive signal selection control circuit 200 are described using FIG. 7. FIG. 7 is a diagram describing the operations of the drive signal selection control circuit 200. The print data signal SI is synchronized with the clock signal SCK and serially input. Then, the print data signal SI is sequentially transferred to the shift registers 212 corresponding to the ejectors 600. When the input of the clock signal SCK is stopped, the 2-bit print data item [SIH, SIL] corresponding to each of the ejectors 600 is held in each of the shift registers 212. The print data signal SI is input in the order of the ejectors 600 corresponding to the n-th, . . . , second, and first stages of the shift registers 212.

When the latch signal LAT rises, the latch circuits 214 simultaneously latch the 2-bit print data items [SIH, SIL] held in the shift registers 212. In FIG. 7, LT1, LT2, . . . , LTn indicate the 2-bit print data items [SIH, SIL] latched by the latch circuits 214 corresponding to the shift registers 212 at the first, second, . . . , n-th stages, respectively.

Each of the decoders 216 outputs logical levels of the selection signals S1, S2, and S3 in the cycle T based on dot sizes defined in the latched 2-bit print data item [SIH, SIL]. In this case, the logical levels are levels illustrated in FIG. 5.

Specifically, when the print data item [SIH, SIL] is [1, 1], the decoder 216 sets the selection signal S1 to an H level, the selection signal S2 to an L level, and the selection signal S3 to an L level in the cycle T. In this case, the selecting circuit 230 selects the trapezoidal waveform Adp in the cycle T1. As a result, the selecting circuit 230 outputs a drive signal VOUT corresponding to "large dot LD".

When the print data item [SIH, SIL] is [1, 0], the decoder 216 sets the selection signal S1 to an L level, the selection signal S2 to an H level, and the selection signal S3 to an L level in the cycle T. In this case, the selecting circuit 230 selects the trapezoidal waveform Bdp in the cycle T. As a result, the selecting circuit 230 outputs a drive signal VOUT corresponding to "small dot SD".

When the print data item [SIH, SIL] is [0, 1], the decoder 216 sets the selection signal S1 to an L level, the selection signal S2 to an L level, and the selection signal S3 to an L level in the cycle T. In this case, the selecting circuit 230 does not select any of the trapezoidal waveforms Adp, Bdp, and Cdp in the cycle T1. As a result, the selecting circuit 230 outputs a drive signal VOUT corresponding to "non-ejection ND". The drive signal VOUT corresponding to "non-ejection ND" is a signal with a waveform of the fixed voltage Vc. When any of the trapezoidal waveforms Adp, Bdp, and Cdp is not selected as a drive signal VOUT, the voltage Vc immediately before the trapezoidal waveforms is held in a capacity component of the piezoelectric element 60. Therefore, when the selecting circuit 230 does not select any of the trapezoidal waveforms Adp, Bdp, and Cdp, the voltage Vc is supplied as the drive signal VOUT to the piezoelectric element 60.

When the print data item [SIH, SIL] is [0, 0], the decoder 216 sets the selection signal S1 to an L level, the selection signal S2 to an L level, and the selection signal S3 to an H level in the cycle T. In this case, the selecting circuit 230 selects the trapezoidal waveform Cdp in the cycle T1. As a result, the selecting circuit 230 outputs a drive signal VOUT corresponding to "slight vibration BSD".

As described above, the drive signal selection control circuit 200 generates a drive signal VOUT for each of the ejectors 600 by selecting or not selecting each of the drive signals COMA, COMB, and COMC based on the print data signal SI, the latch signal LAT, and the clock signal SCK, and outputs the drive signals VOUT to the corresponding ejectors 600.

1.3 Structures of Liquid Ejecting Heads

Figure 8:
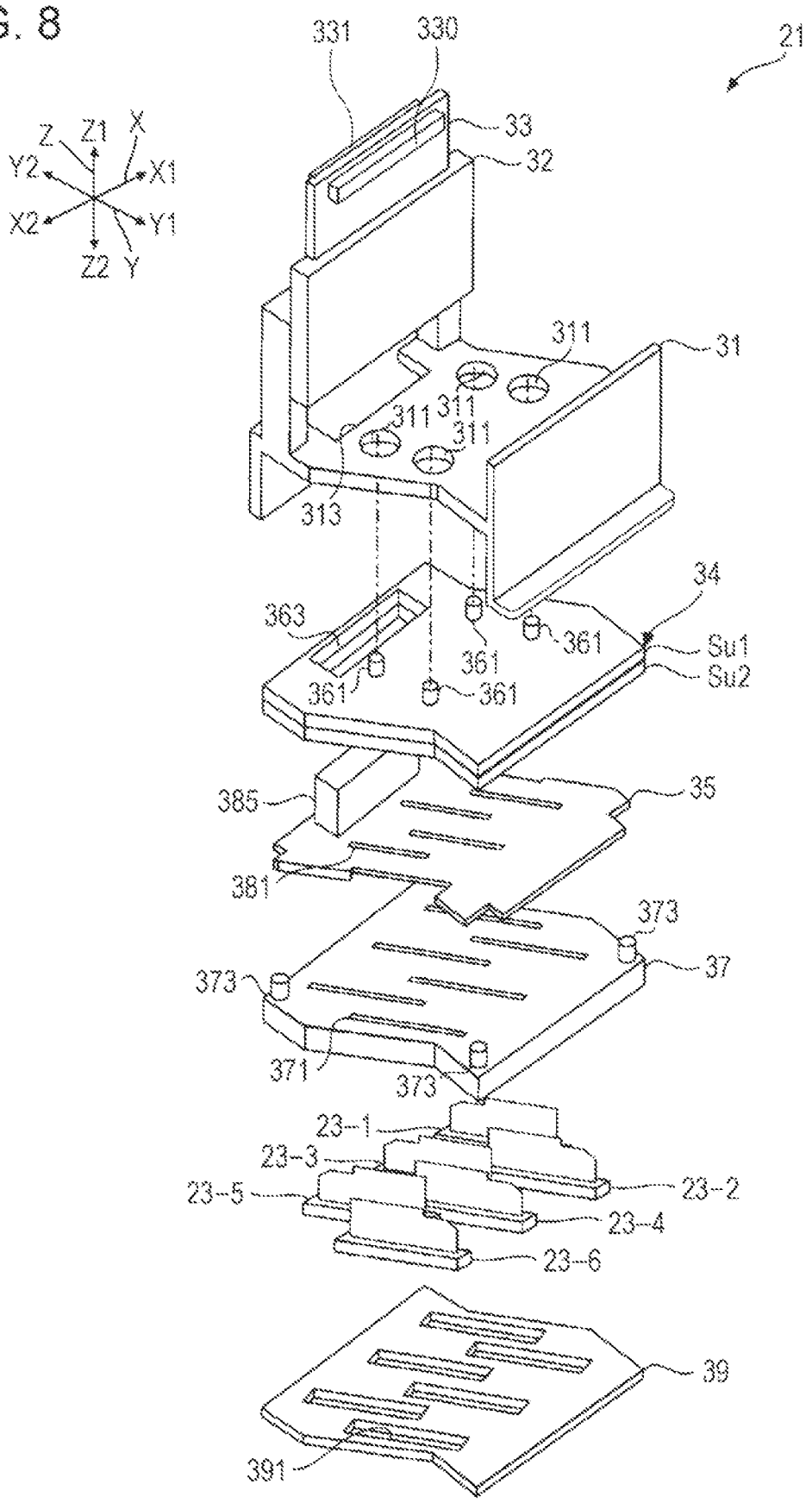
FIG. 8 is a disassembled perspective view of a liquid ejecting head.

Next, the structure of each of the liquid ejection heads 21 is described. FIG. 8 is a disassembled perspective view of the liquid ejecting head 21. The structure is described below using an X-axis direction, a Y-axis direction, and a Z-axis direction that are illustrated in FIG. 8 and perpendicular to each other. As illustrated in FIG. 8, one direction in which the X-axis direction extends is referred to as X1 direction in some cases, the other direction is referred to as X2 direction in some cases, one direction in which the Y-axis direction extends is referred to as Y1 direction in some cases, the other direction is referred to as Y2 direction in some cases, one direction in which the Z-axis direction extends is referred to as Z1 direction in some cases, the other direction is referred to as Z2 direction in some cases.

As illustrated in FIG. 8, the liquid ejecting head 21 includes a casing 31, a cover substrate 32, an assembly substrate 33, a flow path structure 34, a wiring substrate 35, a flow path distributor 37, and a fixed plate 39. The following description assumes that the liquid ejecting head 21 includes six ejection modules 23-1, 23-2, 23-3, 23-4, 23-5, and 23-6. The flow path structure 34 includes flow path plates Su1 and Su2, four supply coupling portions 361, and a coupler hole 363.

The casing 31 supports the flow path structure 34, the wiring substrate 35, the flow path distributor 37, and the fixed plate 39. The casing 31 has four supply holes 311 and an assembly substrate hole 313. The four supply coupling portions 361 are inserted through and fitted to the corresponding four supply holes 311. The ink is supplied to the supply coupling portions 361 from the liquid container 2. The assembly substrate 33 is inserted through the assembly substrate hole 313.

The cover substrate 32 holds the assembly substrate 33 between the cover substrate 32 and a portion, extending toward the Z1 direction, of the casing 31. Since the cables 15 are coupled to the assembly substrate 33, couplers 330 and 331 to which various control signals output by the control unit 10, a power supply voltage, and the like are supplied are mounted on the assembly substrate 33. In addition, wirings for transmitting the various control signals supplied from the control unit 10 through the couplers 330 and 331 and the power supply voltage are formed on the assembly substrate 33. The wirings are not illustrated.

The flow path structure 34 has an ink flow path formed therein. The flow path structure 34 is positioned between the casing 31 and the wiring substrate 35. The flow path plates Su1 and Su2 included in the flow path structure 34 are stacked in the Z-axis direction and joined to each other by an adhesive or the like. The flow path plates Su1 and Su2 are, for example, formed by resin injection molding. The four supply coupling portions 361 included in the flow path structure 34 are mounted on the flow path plate Su1 and protrude from the flow path plate Su1 toward the Z1 direction. In addition, a coupler 385 included in the wiring substrate 35 is inserted through the coupler hole 363 of the flow path structure 34. A filter or the like that captures a foreign substance included in ink to be supplied through the supply coupling portions 361 may be included in the flow path structure 34.

The wiring substrate 35 includes the coupler 385 electrically coupled to the assembly substrate 33. Therefore, the various control signals supplied from the control unit 10 and the power supply voltage are propagated to the wiring substrate 35. In addition, wirings for distributing and transmitting the various control signals supplied through the coupler 385 and the power supply voltage to each of the six ejection modules 23 are formed on the wiring substrate 35. The wirings are not illustrated. The wiring substrate 35 is positioned between the flow path structure 34 and the flow path distributor 37. Furthermore, the wiring substrate 35 has six openings 381 formed therein. Wiring members 388 included in the ejection modules 23-1 to 23-6 are inserted through the six openings 381. The wiring members 388 are described later.

The flow path distributor 37 is positioned between the wiring substrate 35 and the fixed plate 39 and fixed to the fixed plate 39 via an adhesive or the like. Therefore, the flow path distributor 37 functions as a reinforcing member that reinforces the fixed plate 39. In addition, four introduction coupling portions 373 are mounted on a surface of the flow path distributor 37 on the Z1 direction side. The four introduction coupling portions 373 are flow path pipes protruding toward the Z1 direction from the surface of the flow path distributor 37 on the Z1 direction side. The four introduction coupling portions 373 communicate with flow path holes formed in a surface of the flow path structure 34 on the Z2 direction side. The flow path holes are not illustrated. Therefore, the ink is supplied to the flow path distributor 37 through the flow path structure 34. The flow path distributor 37 distributes the supplied ink to the ejection modules 23-1 to 23-6. That is, the flow path distributor 37 functions as a distribution flow path for distributing the ink to each of the ejection modules 23-1 to 23-6.

The flow path distributor 37 has six openings 371 extending through the flow path distributor 37 in the Z-axis direction. The wiring members 388 included in the ejection modules 23-1 to 23-6 are inserted through the openings 371.

Figure 9:
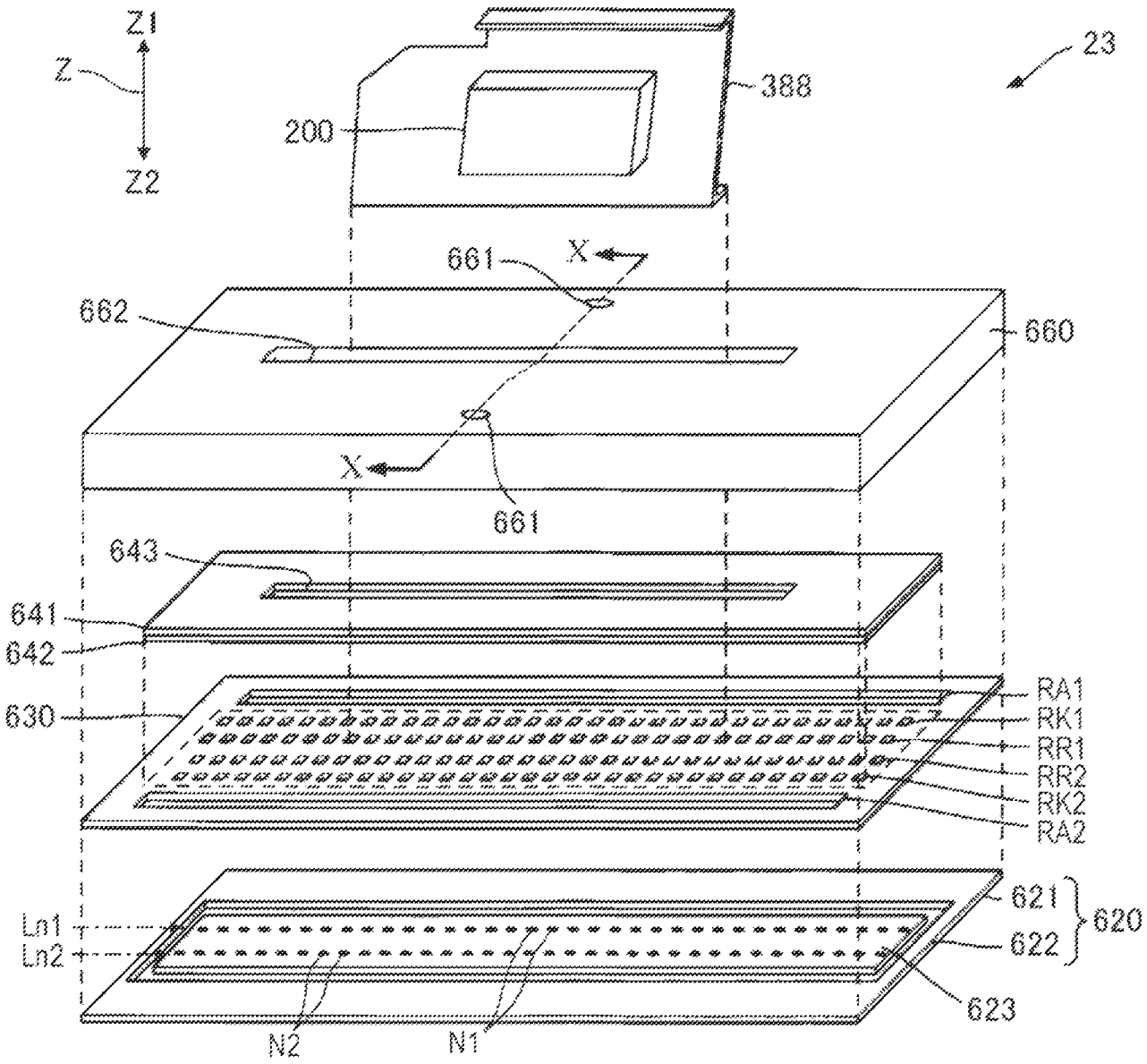
FIG. 9 is a disassembled perspective view of an ejection module.
Figure 10:
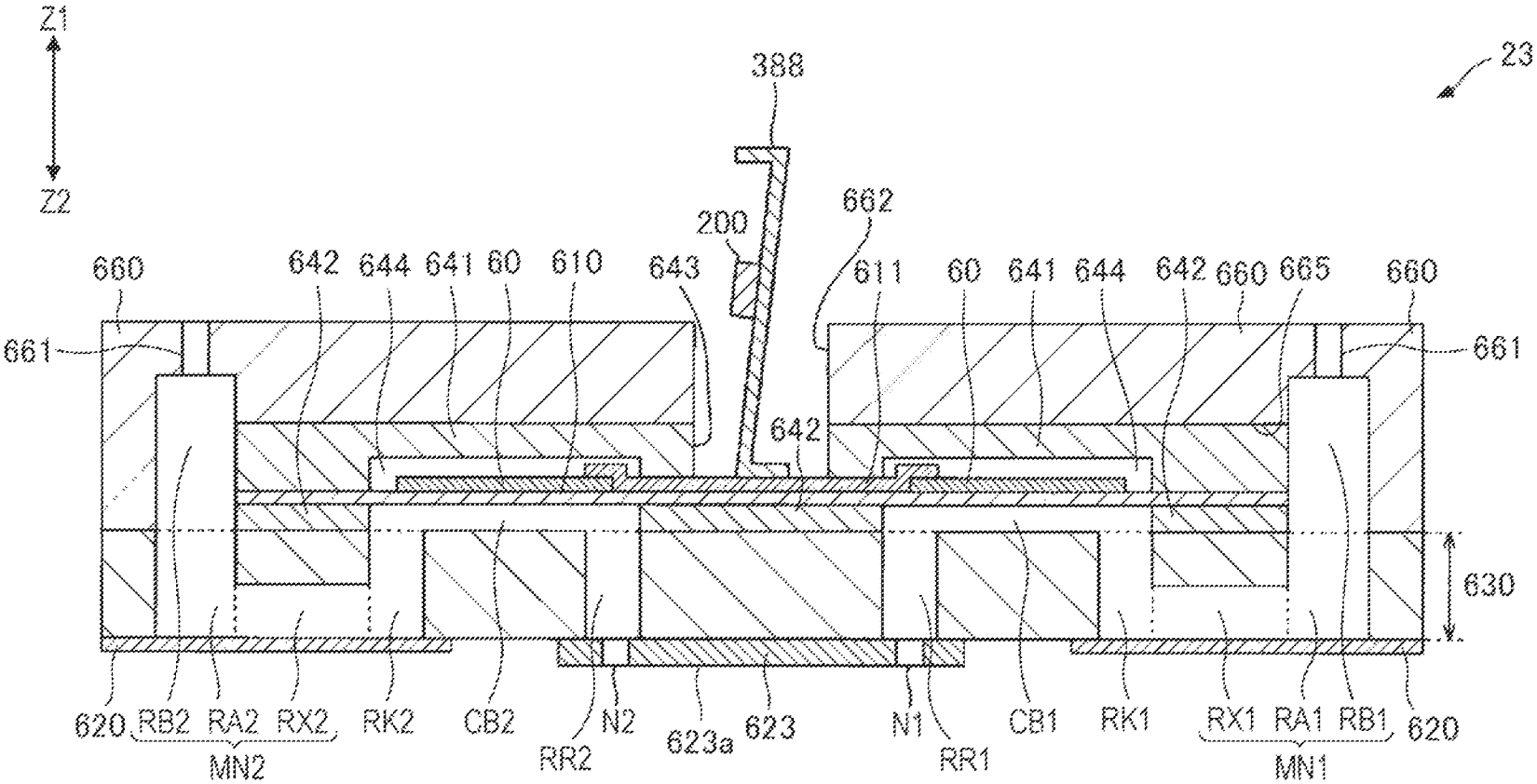
FIG. 10 is a cross-sectional view taken along a line X-X illustrated in FIG. 9.

The six ejection modules 23 are positioned between the flow path distributor 37 and the fixed plate 39. A specific example of the structure of each of the ejection modules 23 is described below using FIGS. 9 and 10. FIG. 9 is a disassembled perspective view of the ejection module 23. FIG. 10 is a cross-sectional view taken along a line X-X illustrated in FIG. 9. The line X-X is a virtual line that extends through introduction paths 661 illustrated in FIG. 9 and extends through nozzles N1 and N2.

The ejection module 23 includes a number n/2 of nozzles N1 and a number n/2 of nozzles N2. In the following description, when the nozzles N1 and the nozzles N2 do not need to be distinguished, the nozzles N1 and N2 are merely referred to as nozzles N in some cases.

As illustrated in FIGS. 9 and 10, the ejection module 23 includes the wiring member 388, a case 660, a protective substrate 641, a flow path formation substrate 642, a communication plate 630, a compliant substrate 620, and a nozzle plate 623. The members included in the ejection module 23 are joined via an adhesive or the like.

The flow path formation substrate 642 has pressure chambers CB1 and CB2 formed by anisotropic etching from one direction. The pressure chambers CB1 and the pressure chambers CB2 are sectioned by a plurality of partition walls and arranged side by side. In the following description, when the pressure chambers CB1 and the pressure chambers CB2 do not need to be distinguished, the pressure chambers CB1 and the pressure chambers CB2 are merely referred to as pressure chambers CB in some cases. Two rows that are a row of the pressure chambers CB1 and a row of the pressure chambers CB2 are arranged side by side in the flow path formation substrate 642. The flow path formation substrate 642 may have a supply path or the like that is present on one end side of the pressure chambers CB, has a smaller opening area than those of the pressure chambers CB, and gives resistance to the flow of the ink into the pressure chambers CB.

The communication plate 630 is joined to a surface of the flow path formation substrate 642 on the Z2 direction side. The nozzle plate 623 having, formed therein, a plurality of nozzles N communicating with the pressure chambers CB is joined to a surface of the communication plate 630 on the Z2 direction side. In the following description, a surface of the nozzle plate 623 that is present on the Z2 direction side and on which the nozzles N are opened is referred to as liquid ejection surface 623*a* in some cases.

The communication plate 630 has nozzle communication paths RR1 coupling the pressure chambers CB1 to the nozzles N1 and nozzle communication paths RR2 coupling the pressure chambers CB2 to the nozzles N2. In the following description, when the nozzle communication paths RR1 and the nozzle communication paths RR2 do not need to be distinguished, the nozzle communication paths RR1 and the nozzle communication paths RR2 are merely referred to as nozzle communication paths RR in some cases. The communication plate 630 has a larger area than that of the flow path formation substrate 642. The nozzle plate 623 has a smaller area than that of the flow path formation substrate 642.

The communication plate 630 has a supply communication path RA1 and a coupling communication path RX1 that constitute a portion of a manifold MN1. The supply communication path RA1 extends through the communication plate 630 in the Z-axis direction. The coupling communication path RX1 is opened toward the nozzle plate 623 and extends to a certain position within the communication plate 630 in the Z-axis direction without extending through the communication plate 630 in the Z-axis direction. Similarly, the communication plate 630 has a supply communication path RA2 and a coupling communication path RX2 that constitute a portion of a manifold MN2. The supply communication path RA2 extends through the communication plate 630 in the Z-axis direction. The coupling communication path RX2 is opened toward the nozzle plate 623 in the communication plate 623 and extends to a certain position within the communication plate 630 in the Z-axis direction without extending through the communication plate 630 in the Z-axis direction. In the following description, when the manifold MN1 and the manifold MN2 do not need to be distinguished, the manifold MN1 and the manifold MN2 are merely referred to as manifolds MN in some cases. When the supply communication path RA1 and the supply communication path RA2 do not need to be distinguished, the supply communication path RA1 and the supply communication path RA2 are merely referred to as supply communication paths RA in some cases. When the coupling communication path RX1 and the coupling communication path RX2 do not need to be distinguished, the coupling communication path RX1 and the coupling communication path RX2 are merely referred to as coupling communication paths RX in some cases.

The communication plate 630 has, for each of the pressure chambers CB1, a pressure chamber communication path RK1 communicating with an end portion of the pressure chamber CB1 and has, for each of the pressure chambers CB2, a pressure chamber communication path RK2 communicating with an end portion of the pressure chamber CB2. The pressure chamber communication paths RK1 are independent of the pressure chamber communication path RK2. The pressure chamber communication paths RK1 couple the coupling communication path RX1 to the pressure chambers CB1, while the pressure chamber communication path RK2 couple the coupling communication path RX2 to the pressure chambers CB2.

The nozzle plate 623 has the nozzles N arranged in rows and communicating with the pressure chambers CB through the nozzle communication paths RR. A row of the plurality of nozzles N1 among the nozzles N forming the rows is referred to as nozzle row Ln1, while a row of the plurality of nozzles N2 among the nozzles N forming the rows is referred to as nozzle row Ln2.

A vibrating plate 610 is formed on a surface of the flow path formation substrate 642 on the Z1 direction side. A piezoelectric element 60-1 and a piezoelectric element 60-2 that are among the piezoelectric elements 60 are mounted on the vibrating plate 610. One of electrodes of each of the piezoelectric elements 60 and a piezoelectric layer are formed for each of the pressure chambers CB, while the other electrode of each of the piezoelectric elements 60 is configured as a common electrode common to the pressure chambers CB. A drive signal VOUT is supplied to the one of the electrodes of each of the piezoelectric elements 60 from the drive signal selection control circuit 200, while a reference voltage signal VBS is supplied to the other electrode of each of the piezoelectric elements 60.

The protective substrate 641 of a size substantially the same as that of the flow path formation substrate 642 is joined to the surface of the flow path formation substrate 642 on the Z1 direction side. The protective substrate 641 has a holding section 644 that is a space for protecting the piezoelectric elements 60. The protective substrate 641 has a through-hole 643 extending through the protective substrate 641 in the Z-axis direction. End portions of lead electrodes 611 drawn from the electrodes of the piezoelectric elements 60 extend and are exposed in the through-hole 643. The lead electrodes 611 are electrically coupled to the wiring member 388 in the through-hole 643.

The case 660 that defines the manifolds MN communicating with the plurality of pressure chambers CB is fixed to the protective substrate 641 and the communication plate 630. The case 660 has substantially the same shape as that of the communication plate 630 in plan view. The case 660 is joined to the protective substrate 641 and the communication plate 630. Specifically, the case 660 has, in its surface on the Z2 direction side, a recess portion 665 with a depth enabling the flow path formation substrate 642 and the protective substrate 641 to be stored in the case 660. The recess portion 665 has a larger opening area than that of a surface of the protective substrate 641 that is joined to the flow path formation substrate 642. In a state in which the flow path formation substrate 642 and the like are stored in the recess portion 665, an opening surface of the recess portion 665 on the Z2 direction side is sealed with the communication plate 630. Therefore, at an outer circumferential portion of the flow path formation substrate 642, a supply communication path RB1 and a supply communication path RB2 are defined by the case 660, the flow path formation substrate 642, and the protective substrate 641. When the supply communication path RB1 and the supply communication path RB2 do not need to be distinguished, the supply communication path RB1 and the supply communication path RB2 are merely referred to as supply communication paths RB in some cases. The supply communication path RB1, the supply communication path RA1 formed in the communication plate 630, and the coupling communication path RX1 formed in the communication plate 630 constitute the manifold MN1, while the supply communication path RB2, the supply communication path RA2 formed in the communication plate 630, and the coupling communication path RX2 formed in the communication plate 630 constitute the manifold MN2.

The compliant substrate 620 is mounted on the surface of the communication plate 630 on which the supply communication paths RA and the coupling communication paths RX are opened. The openings of the supply communication paths RA and the openings of the coupling communication paths RX are sealed with the compliant substrate 620. The compliant substrate 620 includes a sealing film 621 and a fixed substrate 622. The sealing film 621 is formed of a flexible thin film or the like. The fixed substrate 622 is formed of a hard material such as metal that is stainless steel or the like.

The case 660 has an introduction path 661 for supplying the ink to the manifolds MN. The case 660 has a coupling opening 662 communicating with the through-hole 643 of the protective substrate 641. The wiring member 388 is inserted through the coupling opening 662. The coupling opening 662 extends through the case 660 in the Z-axis direction and communicates with one of the openings 381 of the wiring substrate 35 and one of the openings 371 of the flow path distributor 37.

The wiring member 388 is a flexible substrate that electrically couples the wiring substrate 35 to the ejection module 23. The wiring member 388 is, for example, a flexible substrate such as a flexible printed circuit (FPC). The drive signal selection control circuit 200 is implemented in the wiring member 388.

In the ejection module 23 configured in the foregoing manner, drive signals VOUT output by the drive signal selection control circuit 200 and the reference voltage signal VBS are supplied to the piezoelectric elements 60. The piezoelectric elements 60 are driven and deformed in a vertical direction based on changes in potentials of the drive signals VOUT. The vibrating plate 610 is deformed due to the driving and deformation of the piezoelectric elements 60 to change pressure within the pressure chambers CB. The ink stored in the pressure chambers CB is ejected from the nozzles N through the nozzle communication paths RR due to the changes in the pressure within the pressure chambers CB. A configuration including the nozzles N, the nozzle communication paths RR, the pressure chambers CB, the piezoelectric elements 60, and the vibrating plate 610 corresponds to the ejectors 600.

Returning to FIG. 8, the fixed plate 39 has six exposed opening portions 391 each having a larger opening area than that of the nozzle plate 623 included in each of the ejection modules 23. The fixed plate 39 is bonded to surfaces of the compliant substrates 620 of the ejection modules 23 on the Z2 direction side in such a manner that the liquid ejection surfaces 623*a* of the nozzle plates 623 included in the six ejection modules 23 are exposed from the six exposed opening portions 391.

1.4 Allocation of Signals to be Supplied to Liquid Ejecting Heads

In the liquid ejecting apparatus 1 configured in the foregoing manner according to the present embodiment, the piezoelectric elements 60 that cause the liquid ejecting heads 21 to eject the ink are driven by simultaneously transferring the three types of drive signals, which are the drive signals COMA1 to COMAm to form large dots LD on the medium P, the drive signals COMB1 to COMBm to form small dots SD on the medium P, and the drive signals COMC1 to COMCm to perform slight vibration BSD. This can reduce the cycle T in which the ink is ejected from the liquid ejecting apparatus 1, and can improve a speed until the completion of the ejection of the ink to the medium P that is a target object. The speed is a speed until the completion of printing.

In the liquid ejecting apparatus 1 according to the present embodiment, the drive signals COMA1 to COMAm, COMB1 to COMBm, and COMC1 to COMCm output by the driving circuit 50-1 included in the control unit 10 are propagated through the cables 15 and supplied to the liquid ejecting heads 21 through the couplers 330 and 331 mounted on the liquid ejecting heads 21 included in the head unit 20. In the liquid ejecting apparatus 1, it is difficult to dispose circuit components that reduce mutual interference in the cables 15 through which the drive signals COMA1 to COMAm, COMB1 to COMBm, and COMC1 to COMCm propagate, the couplers 330 and 331, and coupling sections in which the cables 15 are coupled to the couplers 330 and 331, and it is difficult to arrange propagation paths through which the drive signals COMA1 to COMAm, COMB1 to COMBm, and COMC1 to COMCm propagate in such a manner that the propagation paths are separated from each other. Therefore, there is a possibility that the drive signals COMA1 to COMAm, COMB1 to COMBm, and COMC1 to COMCm may interfere with each other. As a result, the accuracy of the drive signals COMA1 to COMAm, COMB1 to COMBm, and COMC1 to COMCm transferred to the liquid ejecting heads 21 may be reduced.

Especially, the drive signals COMC1 to COMCm that have a smaller voltage amplitude than those of the drive signals COMA1 to COMAm and COMB1 to COMBm are easily affected by the drive signals COMA1 to COMAm and COMB1 to COMBm with the larger voltage amplitudes. Therefore, it is requested to reduce a possibility that the drive signals COMA1 to COMAm and COMB1 to COMBm may interfere with the drive signals COMC1 to COMCm.

For this request, the cables 15 and the couplers 330 and 331 that propagate the drive signals COMA1, COMB1, and COMC1 to be supplied to the ejection module 23-1 are configured as follows in the liquid ejecting apparatus 1 according to the present embodiment. That is, wirings that are included in the cables 15 and through which the drive signal COMB1 propagates are positioned between wirings that are included in the cables 15 and through which the drive signal COMA1 propagates and wirings that are included in the cables 15 and through which the drive signal COMC1 propagates. A terminal that is included in the coupler 330 or 331 and through which the drive signal COMB1 propagates is positioned between a terminal that is included in the coupler 330 or 331 and through which the drive signal COMA1 propagates and a terminal that is included in the coupler 330 or 331 and through which the drive signal COMC1 propagates. In each of the liquid ejecting heads 21, a coupling section in which a wiring that is included in either one of the cables 15 and through which the drive signal COMB1 propagates is coupled to a terminal of the coupler 330 or 331 is positioned between a coupling section in which a wiring that is included in the cable 15 and through which the drive signal COMA1 propagates is coupled to a terminal of the coupler 330 or 331 and a coupling section in which a wiring that is included in the cable 15 and through which the drive signal COMC1 propagates is coupled to a terminal of the coupler 330 or 331.

In other words, the wiring that is included in the cable 15 and through which the drive signal COMC1 propagates is not positioned between the wiring that is included in the cable 15 and through which the drive signal COMA1 propagates and the wiring that is included in the cable 15 and through which the drive signal COMB1 propagates. The terminal that is included in the coupler 330 or 331 and through which the drive signal COMC1 propagates is not positioned between the terminal that is included in the coupler 330 or 331 and through which the drive signal COMA1 propagates and the terminal that is included in the coupler 330 or 331 and through which the drive signal COMB1 propagates. In each of the liquid ejecting heads 21, the coupling section in which the wiring that is included in the cable 15 and through which the drive signal COMC1 propagates is coupled to the terminal of the coupler 330 or 331 is not positioned between the coupling section in which the wiring that is included in the cable 15 and through which the drive signal COMA1 propagates is coupled to the terminal of the coupler 330 or 331 and the coupling section in which the wiring that is included in the cable 15 and through which the drive signal COMB1 propagates is coupled to the terminal of the coupler 330 or 331.

Therefore, a path through which the drive signal COMC1 with the smaller voltage amplitude than those of the drive signals COMA1 and COMB1 propagates can be separated from at least any one of a path through which the drive signal COMA1 propagates and a path through which the drive signal COMB1 propagates. As a result, it is possible to reduce a possibility that the drive signals COMA1 and COMB1 with the large voltage amplitudes may interfere with the drive signal COMC1 with the small voltage amplitude.

As described above, the liquid ejecting apparatus 1 according to the present embodiment uses the characteristic signal allocation to the couplers 330 and 331 and the cables 15 through which the drive signals COMA1 to COMAm, COMB1 to COMBm, and COMC1 to COMCm output by the control unit 10 propagate. A specific example of the characteristic signal allocation is described below using the drawings. The following description exemplifies the case where each of the liquid ejecting heads 21 has six ejection modules 23, like the case described with reference to FIGS. 8 to 10.

Before the description of the specific example of the signal allocation to the cables 15 and the couplers 330 and 331, a configuration of each of the cables 15 that propagate the drive signals COMA1 to COMAm, COMB1 to COMBm, and COMC1 to COMCm and configurations of the couplers 330 and 331 to which the cables 15 are attached are described below. After the description, the coupling sections in which the wirings included in the cables 15 are coupled to the terminals included in the couplers 330 and 331 are described in detail, and the specific example of the signal allocation to the cables 15, the couplers 330 and 331, and the coupling sections in which the cables 15 are coupled to the couplers 330 and 331 is described.

Figure 11:
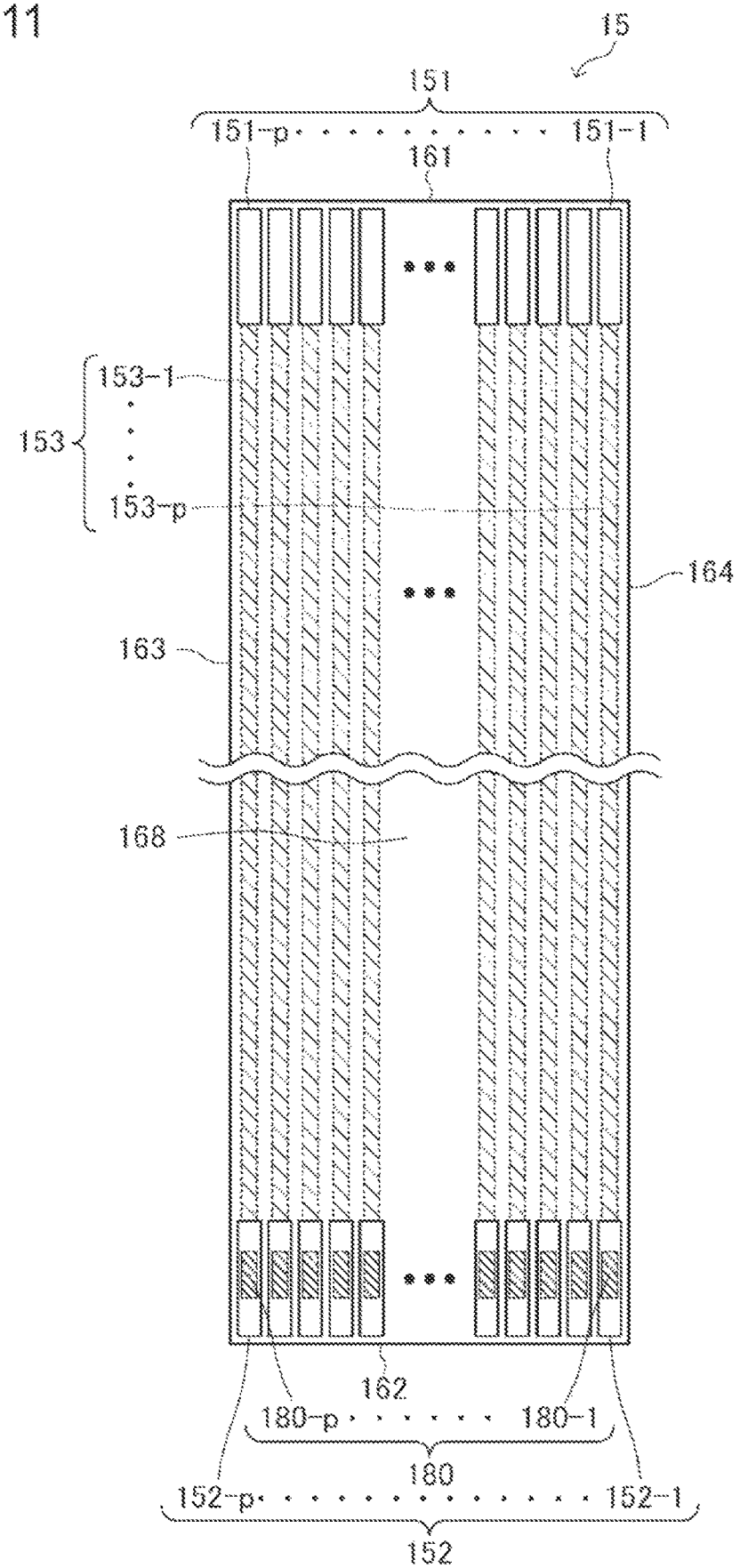
FIG. 11 is a diagram illustrating a configuration of a cable.

First, the configuration of each of the cables 15 that electrically couple the control unit 10 to the liquid ejecting heads 21 is described. FIG. 11 is a diagram illustrating the configuration of the cable 15. As illustrated in FIG. 11, the cable 15 has short sides 161 and 161 opposite to each other and long sides 163 and 164 opposite to each other and is formed in a substantially rectangular shape. The cable 15 includes a plurality of terminals 151 arranged side by side along the short side 161, a plurality of terminals 152 arranged side by side along the short side 162, and a plurality of wirings 153 electrically coupling the plurality of terminals 151 to the plurality of terminals 152.

Specifically, a number p of terminals 151 are arranged on the short side 161 side of the cable 15 in order from the terminal 151-1 on the long side 164 side to the terminal **151-*p* on the long side 163 side. In addition, a number p of terminals 152 are arranged on the short side 162 side of the cable 15 in order from the terminal 152-1 on the long side 164 side to the terminal 152-*p* on the long side 163 side. The cable 15 includes a number p of wirings 153 electrically coupling the terminals 151 to the terminals 152. The number p of wirings 153 are arranged in order from the wiring 153-1 on the long side 164 side to the wiring 153-*p* on the long side 163 side. The wiring 153-1 electrically couples the terminal 151-1 to the terminal 152-1. Similarly, a wiring 153-*j* (j is any one of numbers 1 to p) electrically couples a terminal 151-*j* to a terminal 152-*j*. In the cable 15 configured in the foregoing manner, the number p of terminals 151 are coupled to the control unit 10 and the number p of terminals 152 are coupled to the liquid ejecting heads 21. The cable 15 propagates a signal input from the terminal 151-*j* through the wiring 153-*j* and outputs the signal from the terminal 152-*j***.

Each of the wirings 153 included in the cable 15 is covered with an insulating body 158. Therefore, the plurality of wirings 153 are insulated from each other.

The liquid ejecting apparatus 1 according to the present embodiment includes the two cables 15, which are the cable 15 coupling the control unit 10 to the couplers 330 included in the liquid ejecting heads 21 and the cable 15 coupling the control unit 10 to the couplers 331 included in the liquid ejecting heads 21. In the following description, when the cable 15 coupled to the couplers 330 and the cable 15 coupled to the couplers 331 need to be distinguished, the cable 15 coupled to the couplers 330 is referred to as cable **15*a* and the cable 15 coupled to the couplers 331 is referred to as cable 15*b*. In this case, the plurality of terminals 151 included in the cable 15*a* are referred to as plurality of terminals 151*a*. The plurality of terminals 152 included in the cable 15*a* are referred to as plurality of terminals 152*a*. The plurality of wirings 153 included in the cable 15*a* are referred to as plurality of wirings 153*a*. The plurality of terminals 151 included in the cable 15*b* are referred to as plurality of terminals 151*b*. The plurality of terminals 152 included in the cable 15*b* are referred to as plurality of terminals 152*b*. The plurality of wirings 153 included in the cable 15*b* are referred to as plurality of wirings 153*b***.

Figure 12:
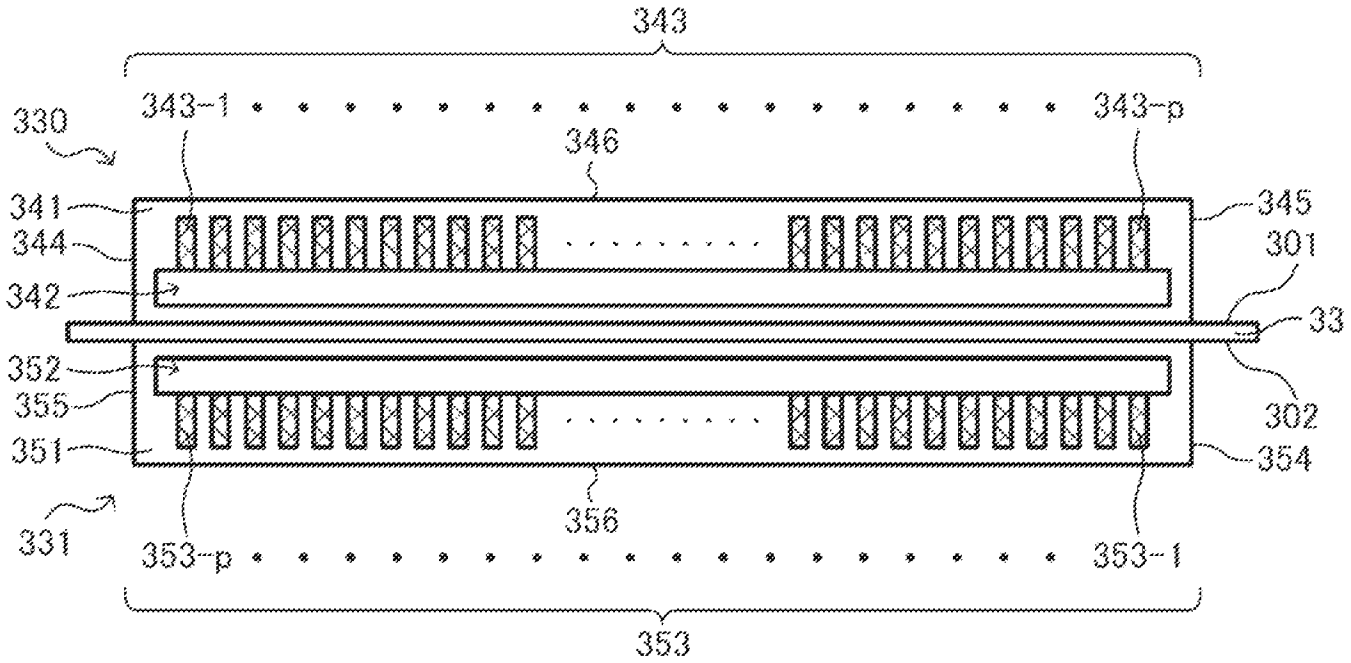
FIG. 12 is a diagram illustrating a configuration of couplers.

Next, configurations of the couplers 330 and 331 coupled to the cables **15*a* and 15*b* are described. FIG. 12 is a diagram illustrating the configurations of the couplers 330 and 331. As illustrated in FIG. 12, each of the couplers 330 is mounted on a surface 301 of the assembly substrate 33 and each of the couplers 331 is mounted on a surface 302 of the assembly substrate 33. The surface 301 is opposite to the surface 302**.

The coupler 330 has a plurality of sides, a side 344, a side 345 positioned facing the side 344, and a side 346 intersecting the sides 344 and 345 and longer than the side 344. The coupler 330 has a plurality of surfaces formed by the plurality of sides and is formed in a substantially rectangular parallelepiped shape.

As illustrated in FIG. 12, the coupler 330 includes a housing 341, a cable attachment section 342, and a plurality of terminals 343. The cable **15*a* is attached to the cable attachment section 342. The number p of terminals 343 are arranged side by side in order from the terminal 343-1 on the side 344 side to the terminal 343-*p* on the side 345 side. When the cable 15*a* is attached to the cable attachment section 342, each of the terminals 152*a* included in the cable 15*a* is electrically coupled to a respective one of the terminals 343 included in the coupler 330. Specifically, the cable 15*a* is attached to the coupler 330 in such a manner that the plurality of terminals 343-*j* included in the coupler 330 are electrically coupled to the plurality of terminals 152*a*-*j* included in the cable 15*a*. Therefore, various signals output by the control unit 10 are input to the liquid ejecting heads 21**.

The coupler 331 has a plurality of sides, a side 354, a side 355 positioned facing the side 354, and a side 356 intersecting the sides 354 and 355 and longer than the side 354. The coupler 331 has a plurality of surfaces formed by the plurality of sides and is formed in a substantially rectangular parallelepiped shape.

As illustrated in FIG. 12, the coupler 331 includes a housing 351, a cable attachment section 352, and a plurality of terminals 353. The cable **15*b* is attached to the cable attachment section 352. The number p of terminals 353 are arranged side by side in order from the terminal 353-1 on the side 354 side to the terminal 353-*p* on the side 355 side. When the cable 15*b* is attached to the cable attachment section 352, each of the terminals 152*b* included in the cable 15*b* is electrically coupled to a respective one of the terminals 353 included in the coupler 331. Specifically, the cable 15*b* is attached to the coupler 331 in such a manner that the plurality of terminals 353-*j* included in the coupler 331 are electrically coupled to the plurality of terminals 152*b*-*j* included in the cable 15*b*. Therefore, various signals output by the control unit 10 are input to the liquid ejecting heads 21**.

As illustrated in FIG. 12, the coupler 330 and the coupler 331 are arranged facing each other via the assembly substrate 33. Specifically, the couplers 330 and 331 are positioned in such a manner that at least a portion of the terminal 343-1 of the coupler 330 overlaps at least a portion of the terminal 353-*p* of the coupler 331 in a direction from the surface 301 of the assembly substrate 33 to the surface 302 of the assembly substrate 33 and that at least a portion of the terminal 343-*p* of the coupler 330 overlaps at least a portion of the terminal 353-1 of the coupler 331 in the direction from the surface 301 of the assembly substrate 33 to the surface 302 of the assembly substrate 33. That is, the couplers 330 and 331 are positioned in such a manner that at least a portion of a terminal 343-(*j*+1) of the coupler 330 overlaps at least a portion of a terminal 353-(*p*-*j*) of the coupler 331 in the direction from the surface 301 of the assembly substrate 33 to the surface 302 of the assembly substrate 33.

Figure 13:
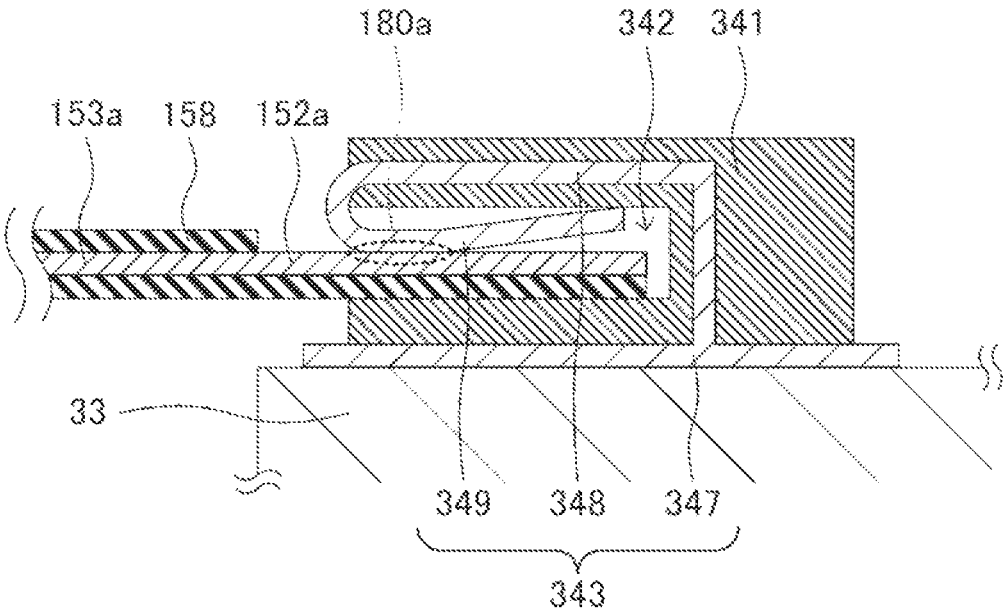
FIG. 13 is a diagram illustrating a coupling section in a state in which a cable is attached to a coupler.
Figure 14:
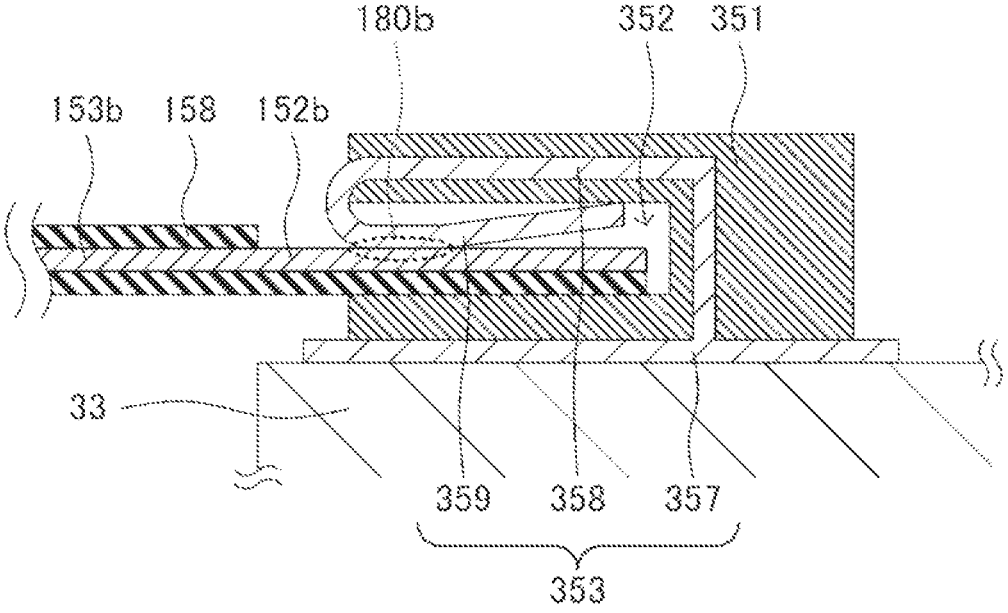
FIG. 14 is a diagram illustrating a coupling section in a state in which a cable is attached to a coupler.

Next, an example of the coupling sections in which the cables 15 are coupled to the couplers 330 and 331 is described. FIG. 13 is a diagram describing a coupling section in a state in which the cable 15*a* is attached to the coupler 330. FIG. 14 is a diagram describing a coupling section in a state in which the cable 15*b* is attached to the coupler 331.

As illustrated in FIG. 13, each of the terminals 343 of the coupler 330 includes a substrate attachment section 347, a housing insertion section 348, and a cable holder 349. The substrate attachment section 347 is positioned on the assembly substrate 33 side of the coupler 330 and between the housing 341 and the assembly substrate 33. The substrate attachment section 347 is electrically coupled to an electrode included in the assembly substrate 33 via solder or the like. The electrode is not illustrated. The housing insertion section 348 is inserted through the housing 341. The housing insertion section 348 electrically couples the substrate attachment section 347 to the cable holder 349. The cable holder 349 protrudes to the inside of the cable attachment section 342 and has a curved portion. When the cable 15*a* is attached to the cable attachment section 342, the cable holder 349 and the terminal 152*a* contact each other via a coupling section 180*a*. Therefore, the cable 15*a* and the coupler 330 are electrically coupled to the assembly substrate 33. In this case, when the cable 15*a* is attached, stress occurs in the curved portion of the cable holder 349. Due to this stress, a portion of the cable 15*a* is held in the cable attachment section 342.

As illustrated in FIG. 14, each of the terminals 353 of the coupler 331 includes a substrate attachment section 357, a housing insertion section 358, and a cable holder 359. The substrate attachment section 357 is positioned on the assembly substrate 33 side of the coupler 331 and between the housing 351 and the assembly substrate 33. The substrate attachment section 357 is electrically coupled to an electrode included in the assembly substrate 33 via solder or the like. The electrode is not illustrated. The housing insertion section 358 is inserted through the housing 351. The housing insertion section 358 electrically couples the substrate attachment section 357 to the cable holder 359. The cable holder 359 protrudes to the inside of the cable attachment section 352 and has a curved portion. When the cable 15*b* is attached to the cable attachment section 352, the cable holder 359 and the terminal 152*b* contact each other via a coupling section 180*b*. Therefore, the cable 15*b* and the coupler 331 are electrically coupled to the assembly substrate 33. In this case, when the cable 15*b* is attached, stress occurs in the curved portion of the cable holder 359. Due to this stress, a portion of the cable 15*b* is held in the cable attachment section 352.

As described above, the cable 15*a* is electrically coupled to the couplers 330 when the terminals 152*a* contact the terminals 343 via the coupling sections 180*a*. The cable 15*b* is electrically coupled to the couplers 331 when the terminals 152*b* contact the terminals 353 via the coupling sections 180*b*. Coupling sections 180-1 to 180-*p* illustrated in FIG. 11 are a general term for coupling sections 180*a* in which the cable 15*a* contacts the couplers 330 and coupling sections 180*b* in which the cable 15*b* contacts the couplers 331.

A specific example of the allocation of drive signals COMA1 to COMA6, COMB1 to COMB6, and COMC1 to COMC6 to the wirings included in the cables 15*a* and 15*b* and the terminals included in the couplers 330 and 331 is described using FIGS. 15 and 16.

FIG. 15 is a diagram illustrating an example of the allocation of the signals that propagate through the wirings 153*a*, the terminals 343, and the coupling sections 180*a* in which the terminals 152*a* are coupled to the terminals 343. FIG. 16 is a diagram illustrating an example of the allocation of the signals that propagate through the wirings 153*b*, the terminals 353, and the coupling sections 180*b* in which the terminals 152*b* are coupled to the terminals 353.

As illustrated in FIGS. 15 and 16, the drive signals COMA1, COMB1, and COMC1 and the reference voltage signal VBS1 that are to be supplied to the ejection module 23-1 included in the liquid ejecting head 21 are propagated through the wirings 153*a*-2 to 153*a*-5 included in the cable 15*a*, the terminals 152*a*-2 to 152*a*-5 included in the cable 15*a*, the terminals 343-2 to 343-5 included in the coupler 330, and the corresponding coupling sections 180*a*-2 to 182*a*-5 and are propagated through the wirings 153*b*-(*p*-1) to 153*b*-(*p*-4) included in the cable 15*b*, the terminals 152*b*-(*p*-1) to 152*b*-(*p*-4) included in the cable 15*b*, the terminals 353-(*p*-1) to 353-(*p*-4) included in the coupler 331, and the corresponding coupling sections 180*b*-(*p*-1) to 182*b*-(*p*-4).

The drive signals COMA2, COMB2, and COMC2 and a reference voltage signal VBS2 that are to be supplied to the ejection module 23-2 included in the liquid ejecting head 21 are propagated through the wirings 153*a*-6 to 153*a*-9 included in the cable 15*a*, the terminals 152*a*-6 to 152*a*-9 included in the cable 15*a*, the terminals 343-6 to 343-9 included in the coupler 330, and the corresponding coupling sections 180*a*-6 to 182*a*-9 and are propagated through the wirings 153*b*-(*p*-5) to 153*b*-(*p*-8) included in the cable 15*b*, the terminals 152*b*-(*p*-5) to 152*b*-(*p*-8) included in the cable 15*b*, the terminals 353-(*p*-5) to 353-(*p*-8) included in the coupler 331, and the corresponding coupling sections 180*b*-(*p*-5) to 182*b*-(*p*-8).

The drive signals COMA3, COMB3, and COMC3 and a reference voltage signal VBS3 that are to be supplied to the ejection module 23-3 included in the liquid ejecting head 21 are propagated through the wirings 153*a*-10 to 153*a*-13 included in the cable 15*a*, the terminals 152*a*-10 to 152*a*-13 included in the cable 15*a*, the terminals 343-10 to 343-13 included in the coupler 330, and the corresponding coupling sections 180*a*-10 to 182*a*-13 and are propagated through the wirings 153*b*-(*p*-9) to 153*b*-(*p*-12) included in the cable 15*b*, the terminals 152*b*-(*p*-9) to 152*b*-(*p*-12) included in the cable 15*b*, the terminals 353-(*p*-9) to 353-(*p*-12) included in the coupler 331, and the corresponding coupling sections 180*b*-(*p*-9) to 182*b*-(*p*-12).

The drive signals COMA4, COMB4, and COMC4 and a reference voltage signal VBS4 that are to be supplied to the ejection module 23-4 included in the liquid ejecting head 21 are propagated through the wirings 153*a*-14 to 153*a*-17 included in the cable 15*a*, the terminals 152*a*-14 to 152*a*-17 included in the cable 15*a*, the terminals 343-14 to 343-17 included in the coupler 330, and the corresponding coupling sections 180*a*-14 to 182*a*-17 and are propagated through the wirings 153*b*-(*p*-13) to 153*b*-(*p*-16) included in the cable 15*b*, the terminals 152*b*-(*p*-13) to 152*b*-(*p*-16) included in the cable 15*b*, the terminals 353-(*p*-13) to 353-(*p*-16) included in the coupler 331, and the corresponding coupling sections 180*b*-(*p*-13) to 182*b*-(*p*-16).

The drive signals COMA5, COMB5, and COMC5 and a reference voltage signal VBS5 that are to be supplied to the ejection module 23-5 included in the liquid ejecting head 21 are propagated through the wirings 153*a*-18 to 153*a*-21 included in the cable 15*a*, the terminals 152*a*-18 to 152*a*-21 included in the cable 15*a*, the terminals 343-18 to 343-21 included in the coupler 330, and the corresponding coupling sections 180*a*-18 to 182*a*-21 and are propagated through the wirings 153*b*-(*p*-17) to 153*b*-(*p*-20) included in the cable 15*b*, the terminals 152*b*-(*p*-17) to 152*b*-(*p*-20) included in the cable 15*b*, the terminals 353-(*p*-17) to 353-(*p*-20) included in the coupler 331, and the corresponding coupling sections 180*b*-(*p*-17) to 182*b*-(*p*-20).

The drive signals COMA6, COMB6, and COMC6 and a reference voltage signal VBS6 that are to be supplied to the ejection module 23-6 included in the liquid ejecting head 21 are propagated through the wirings 153*a*-22 to 153*a*-25 included in the cable 15*a*, the terminals 152*a*-22 to 152*a*-25 included in the cable 15*a*, the terminals 343-22 to 343-25 included in the coupler 330, and the corresponding coupling sections 180*a*-22 to 182*a*-25 and are propagated through the wirings 153*b*-(*p*-21) to 153*b*-(*p*-24) included in the cable 15*b*, the terminals 152*b*-(*p*-21) to 152*b*-(*p*-24) included in the cable 15*b*, the terminals 353-(*p*-21) to 353-(*p*-24) included in the coupler 331, and the corresponding coupling sections 180*b*-(*p*-21) to 182*b*-(*p*-24).

As illustrated in FIGS. 15 and 16, in the cables 15*a* and 15*b* and the couplers 330 and 331, the allocation of the drive signals COMA1, COMB1, and COMC1 and the reference voltage signal VBS1 that are to be supplied to the ejection module 23-1 included in the liquid ejection head 21 is equivalent to the allocation of the drive signals COMA2 to COMA6, COMB2 to COMB6, and COMC2 to COMC6 and the reference voltage signals VBS2 to VBS6 that are to be supplied to the ejection modules 23-2 to 23-6 included in the liquid ejection heads 21. Therefore, in the following description, only the allocation of the drive signals COMA1, COMB1, and COMC1 and the reference voltage signal VBS1 that are to be supplied to the ejection module 23-1 included in the liquid ejection head 21 is described and a detailed description of the allocation of the drive signals COMA2 to COMA6, COMB2 to COMB6, and COMC2 to COMC6 and the reference voltage signals VBS2 to VBS6 that are to be supplied to the ejection modules 23-2 to 23-6 included in the liquid ejection heads 21 is omitted.

The drive signals COMA1, COMB1, and COMC1 and the reference voltage signal VBS1 that are to be supplied to the ejection module 23-1 included in the liquid ejection head 21 are described below in detail. As illustrated in FIGS. 15 and 16, the wiring 153*a*-2, the terminal 152*a*-2, the terminal 343-2, the coupling section 180*a*-2, the wiring 153*a*-(*p*-1), the terminal 152*a*-(*p*-1), the terminal 343-(*p*-1), and the coupling section 180*a*-(*p*-1) propagate the drive signal COMA1. The wiring 153*a*-(*p*-1), the terminal 152*a*-(*p*-1), the terminal 343-(*p*-1), and the coupling section 180*a*-(*p*-1) are positioned facing the wiring 153*a*-2, the terminal 152*a*-2, the terminal 343-2, and the coupling section 180*a*-2 via the assembly substrate 33, respectively. In addition, the wiring 153*a*-3, the terminal 152*a*-3, the terminal 343-3, the coupling section 180*a*-3, the wiring 153*a*-(*p*-2), the terminal 152*a*-(*p*-2), the terminal 343-(*p*-2), and the coupling section 180*a*-(*p*-2) propagate the drive signal COMB1 and are positioned adjacent to the wirings and the terminals through which the drive signal COMA1 is propagated. In addition, the wiring 153*a*-4, the terminal 152*a*-4, the terminal 343-4, the coupling section 180*a*-4, the wiring 153*a*-(*p*-3), the terminal 152*a*-(*p*-3), the terminal 343-(*p*-3), and the coupling section 180*a*-(*p*-3) propagate the reference voltage signal VBS1 and are positioned adjacent to the wirings and the terminals through which the drive signal COMB1 is propagated. Furthermore, the wiring 153*a*-5, the terminal 152*a*-5, the terminal 343-5, the coupling section 180*a*-5, the wiring 153*a*-(*p*-4), the terminal 152*a*-(*p*-4), the terminal 343-(*p*-4), and the coupling section 180*a*-(*p*-4) propagate the drive signal COMC1 and are positioned adjacent to the wirings and the terminals through which the reference voltage signal VBS1 is propagated.

In the cable 15*a*, the wiring 153*a*-3 that propagates the drive signal COMB1 is positioned between the wiring 153*a*-2 that propagates the drive signal COMA1 and the wiring 153*a*-5 that propagates the drive signal COMC1. In the coupler 330, the terminal 343-3 that propagates the drive signal COMB1 is positioned between the terminal 343-2 that propagates the drive signal COMA1 and the terminal 343-5 that propagates the drive signal COMC1. Furthermore, the coupling section 180*a*-3 in which the wiring 153*a*-3 and the terminal 343-3 that propagate the drive signal COMB1 are coupled to each other is positioned between the coupling section 180*a*-2 in which the wiring 153*a*-2 and the terminal 343-2 that propagate the drive signal COMA1 are coupled to each other and the coupling section 180*a*-5 in which the wiring 153*a*-5 and the terminal 343-5 that propagate the drive signal COMC1 are coupled to each other.

Therefore, in the cable 15*a* and the coupler 330, the wiring 153*a*-5, the terminal 343-5, and the coupling section 180*a*-5 through which the drive signal COMC1 with the small voltage amplitude is propagated can be positioned away from the wiring 153*a*-2, the terminal 343-2, and the coupling section 180*a*-2 through which the drive signal COMA1 with the large voltage amplitude is propagated. As a result, it is possible to reduce a possibility that the drive signal COMA1 may be superimposed on the drive signal COMC1 with the small voltage amplitude.

Similarly, in the cable 15*b*, the wiring 153*b*-(*p*-2) that propagates the drive signal COMB1 is positioned between the wiring 153*b*-(*p*-1) that propagates the drive signal COMA1 and the wiring 153*b*-(*p*-4) that propagates the drive signal COMC1. In the coupler 331, the terminal 353-(*p*-2) that propagates the drive signal COMB1 is positioned between the terminal 353-(*p*-1) that propagates the drive signal COMA1 and the terminal 353-(*p*-4) that propagates the drive signal COMC1. The coupling section 180*b*-(*p*-2) in which the wiring 153*b*-(*p*-2) and the terminal 353-(*p*-2) that propagate the drive signal COMB1 are coupled to each other is positioned between the coupling section 180*b*-(*p*-1) in which the wiring 153*b*-(*p*-1) and the terminal 353-(*p*-1) that propagate the drive signal COMA1 are coupled to each other and the coupling section 180*b*-(*p*-4) in which the wiring 153*b*-(*p*-4) and the terminal 353-(*p*-4) that propagate the drive signal COMC1 are coupled to each other.

Therefore, in the cable 15*b* and the coupler 331, the wiring 153*b*-(*p*-4), the terminal 343-(*p*-4), and the coupling section 180*a*-(*p*-4) through which the drive signal COMC1 with the small voltage amplitude is propagated can be positioned away from the wiring 153*a*-(*p*-1), the terminal 343-(*p*-1), and the coupling section 180*a*-(*p*-1) through which the drive signal COMA1 with the large voltage amplitude is propagated. As a result, it is possible to reduce a possibility that the drive signal COMA1 may be superimposed on the drive signal COMC1 with the small voltage amplitude.

As illustrated in FIGS. 15 and 16, the reference voltage signal VBS1 at the fixed potential is propagated through the wiring 153*a*-4, the terminal 152*a*-4, the terminal 343-4, the coupling section 180*a*-4, the wiring 153*a*(*p*-3), the terminal 152*a*-(*p*-3), the terminal 343-(*p*-3), and the coupling section 180*a*-(*p*-3) that are positioned adjacent to the wirings and the terminals through which the drive signal COMB1 is propagated. Therefore, the wirings and the terminals through which the reference voltage signal VBS1 is propagated function as a shield member that reduces a possibility that the drive signal COMA1 may be superimposed on the drive signal COMC1 with the small voltage amplitude. As a result, it is possible to further reduce a possibility that the drive signal COMA1 may be superimposed on the drive signal COMC1 with the small voltage amplitude.

The wiring 153*a*-3 that electrically couples the liquid ejecting heads 21 to the drive signal output circuit 51*b* is an example of a first wiring. The coupling section 180*a*-3 is an example of a first coupling section. At least any one of the wiring 153*a*-3, the terminal 152*a*-3, the terminal 343-3, and the coupling section 180*a*-3 is an example of a first conductive section. The wiring 153*a*-2 that electrically couples the liquid ejecting heads 21 to the drive signal output circuit 51*a* is an example of a second wiring. The coupling section 180*a*-2 is an example of a second coupling section. At least any one of the wiring 153*a*-2, the terminal 152*a*-2, the terminal 343-2, and the coupling section 180*a*-2 is an example of a second conductive section. The wiring 153*a*-4 that electrically couples the liquid ejecting heads 21 to the drive signal output section 51*c* is an example of a third wiring. The coupling section 180*a*-4 is an example of a third coupling section. At least any one of the wiring 153*a*-4, the terminal 152*a*-4, the terminal 343-4, and the coupling section 180*a*-4 is an example of a third conductive section.

The reference voltage signal VBS1 at the fixed potential is an example of a fixed potential signal. The reference voltage output circuit 52 that outputs the reference voltage signal VBS1 is an example of a fixed potential output circuit. At least any one of the wiring 153*a*-4, the terminal 152*a*-4, the terminal 343-4, and the coupling section 180*a*-4 is an example of a fourth conductive section. The wiring 153*a*-4, the terminal 152*a*-4, the terminal 343-4, and the coupling section 180*a*-4 electrically couple the reference voltage output circuit 52 to the second terminals of the piezoelectric elements 60 through which the reference voltage VBS1 as a signal at a fixed potential propagates and that are different from the first terminals of the piezoelectric elements 60 to which the drive signal COMB1 is supplied, and propagate the reference voltage signal VBS1 to the piezoelectric elements 60. At least one of the cable 15*a* and the coupler 330 is an example of a first conductive component.

1.5 Effects

As described above, the liquid ejecting apparatus 1 according to the present embodiment includes the drive signal output circuit 51*a* that outputs the drive signal COMA1, the drive signal output circuit 51*b* that outputs the drive signal COMB1, and the drive signal output circuit 51*c* that outputs the drive signal COMC1 with the smaller voltage amplitude than those of the drive signals COMA1 and COMB1. The liquid ejecting apparatus 1 according to the present embodiment simultaneously propagates the drive signals COMA1, COMB1, and COMC1, thereby improving a speed until the completion of the ejection of a liquid to a target object.

In the liquid ejecting apparatus 1, the wiring 153*a*-3, the terminal 152*a*-3, the terminal 343-3, and the coupling section 180*a*-3 that electrically couple the liquid ejecting head 21 to the drive signal output circuit 51*b* is positioned between the wiring 153*a*-2, the terminal 152*a*-2, the terminal 343-2, and the coupling section 180*a*-2 that electrically couple the liquid ejecting head 21 to the drive signal output circuit 51*a*, and the wiring 153*a*-5, the terminal 152*a*-5, the terminal 343-5, and the coupling section 180*a*-5 that electrically couple the liquid ejecting head 21 to the drive signal output circuit 51*c*. Therefore, the wiring 153*a*-5, the terminal 152*a*-5, the terminal 343-5, and the coupling section 180*a*-5 through which the drive signal COMC1 with the small voltage amplitude propagates can be positioned away from the wiring 153*a*-2, the terminal 152*a*-2, the terminal 343-2, and the coupling section 180*a*-2 through which the drive signal COMA1 propagates. As a result, it is possible to reduce a possibility that the drive signal COMA1 may be superimposed on the drive signal COMC1 with the small voltage amplitude. That is, even when the liquid ejecting apparatus 1 according to the present embodiment outputs the drive signals COMA1, COMB1, and COMC1, it is possible to reduce a possibility that the accuracy of transferring the drive signals COMA1, COMB1, and COMC1 may be reduced.

2. Second Embodiment

Next, a liquid ejecting apparatus 1 according to a second embodiment is described. FIG. 17 is a diagram illustrating an example of the allocation of signals that propagate through wirings 153*a*, terminals 343, and coupling sections 180*a* in which terminals 152*a* are coupled to the terminals 343 according to the second embodiment. FIG. 18 is a diagram illustrating an example of the allocation of signals that propagate through wirings 153*b*, terminals 353, and coupling sections 180*b* in which terminals 152*b* are coupled to the terminals 353 according to the second embodiment.

As illustrated in FIGS. 17 and 18, in the liquid ejecting apparatus 1 according to the second embodiment, a wiring 153*a*-2, a terminal 152*a*-2, a terminal 343-2, a coupling section 180*a*-2, a wiring 153*a*-(*p*-1), a terminal 152*a*-(*p*-1), a terminal 343-(*p*-1), and a coupling section 180*a*-(*p*-1) propagate a drive signal COMA1. The wiring 153*a*-(*p*-1), the terminal 152*a*-(*p*-1), the terminal 343-(*p*-1), and the coupling section 180*a*-(*p*-1) are positioned facing the wiring 153*a*-2, the terminal 152*a*-2, the terminal 343-2, and the coupling section 180*a*-2 via an assembly substrate 33, respectively. In the liquid ejecting apparatus 1 according to the second embodiment, a wiring 153*a*-3, a terminal 152*a*-3, a terminal 343-3, a coupling section 180*a*-3, a wiring 153*a*-(*p*-2), a terminal 152*a*-(*p*-2), a terminal 343-(*p*-2), and a coupling section 180*a*-(*p*-2) propagate a reference voltage signal VBS1 and are positioned adjacent to the wirings and the terminals through which the drive signal COMA1 is propagated. In the liquid ejecting apparatus 1 according to the second embodiment, a wiring 153*a*-4, a terminal 152*a*-4, a terminal 343-4, a coupling section 180*a*-4, a wiring 153*a*-(*p*-3), a terminal 152*a*-(*p*-3), a terminal 343-(*p*-3), and a coupling section 180*a*-(*p*-3) propagate a drive signal COMB1 and are positioned adjacent to the wirings and the terminals through which the reference voltage signal VBS1 is propagated. In the liquid ejecting apparatus 1 according to the second embodiment, a wiring 153*a*-5, a terminal 152*a*-5, a terminal 343-5, a coupling section 180*a*-5, a wiring 153*a*-(*p*-4), a terminal 152*a*-(*p*-4), a terminal 343-(*p*-4), and a coupling section 180*a*-(*p*-4) propagate a drive signal COMC1 and are positioned adjacent to the wirings and the terminals through which the drive signal COMB1 is propagated.

In the liquid ejecting apparatus 1 according to the second embodiment, the wirings and the terminals through which the reference voltage signal VBS1 is propagated are positioned between the wirings and the terminals through which the drive signal COMA1 is propagated and the wirings and the terminals through which the drive signal COMB1 is propagated. Specifically, the wiring 153*a*-3, the terminal 152*a*-3, the terminal 343-3, the coupling section 180*a*-3, the wiring 153*a*-(*p*-2), the terminal 152*a*-(*p*-2), the terminal 343-(*p*-2), and the coupling section 180*a*-(*p*-2) that propagate the reference voltage signal VBS1 at the fixed potential are positioned adjacent to the wiring 153*a*-4, the terminal 152*a*-4, the terminal 343-4, the coupling section 180*a*-4, the wiring 153*a*-(*p*-3), the terminal 152*a*-(*p*-3), the terminal 343-(*p*-3), and the coupling section 180*a*-(*p*-3), respectively, and are positioned adjacent to the wiring 153*a*-2, the terminal 152*a*-2, the terminal 343-2, the coupling section 180*a*-2, the wiring 153*a*-(*p*-1), the terminal 152*a*-(*p*-1), the terminal 343-(*p*-1), and the coupling section 180*a*-(*p*-1), respectively. The wiring 153*a*-4, the terminal 152*a*-4, the terminal 343-4, the coupling section 180*a*-4, the wiring 153*a*-(*p*-3), the terminal 152*a*-(*p*-3), the terminal 343-(*p*-3), and the coupling section 180*a*-(*p*-3) propagate the drive signal COMB1. The wiring 153*a*-2, the terminal 152*a*-2, the terminal 343-2, the coupling section 180*a*-2, the wiring 153*a*-(*p*-1), the terminal 152*a*-(*p*-1), the terminal 343-(*p*-1), and the coupling section 180*a*-(*p*-1) propagate the drive signal COMA1. The wiring 153*a*-(*p*-1), the terminal 152*a*-(*p*-1), the terminal 343-(*p*-1), and the coupling section 180*a*-(*p*-1) are positioned facing the wiring 153*a*-2, the terminal 152*a*-2, the terminal 343-2, and the coupling section 180*a*-2 via the assembly substrate 33, respectively.

The foregoing liquid ejecting apparatus 1 according to the second embodiment has the same effects as those of the liquid ejecting apparatus 1 according to the first embodiment.

To eject a liquid from liquid ejecting heads 21, the drive signals COMA1 and COMB1 are supplied to first terminals of piezoelectric elements 60 and the reference voltage signal VBS1 is supplied to second terminals of the piezoelectric elements 60. That is, electric currents based on the drive signals COMA1 and COMB1 supplied to the piezoelectric elements 60 are fed back to the control unit 10 through the terminals through which the reference voltage signal VBS1 is propagated.

The wirings and the terminals through which the reference voltage signal VBS1 to be supplied to the second terminals of the piezoelectric elements 60 is propagated are positioned between the wirings and the terminals through which the drive signal COMA1 to be supplied to the first terminals of the piezoelectric elements 60 is propagated and the wirings and the terminals through which the drive signal COMB1 to be supplied to the first terminals of the piezoelectric elements 60 is propagated. Therefore, inductance components that occur, due to the supply of the drive signals COMA1 and COMB1 to the piezoelectric elements 60, in the wirings and the terminals through which the drive signals COMA1 and COMB1 are propagated are offset by electric currents that flow in the wirings and the terminals through which the reference voltage signal VBS1 is propagated. As a result, it is possible to reduce the inductance components that occur in the wirings and the terminals through which the drive signals COMA1 and COMB1 are propagated and it is possible to improve the accuracy of transferring the drive signals COMA1 and COMB1.

The wiring 153*a*-4 that electrically couples the liquid ejecting heads 21 to a drive signal output circuit 51*b* is an example of a first wiring according to the second embodiment. The coupling section 180*a*-4 is an example of a first coupling section according to the second embodiment. At least any one of the wiring 153*a*-4, the terminal 152*a*-4, the terminal 343-4, and the coupling section 180*a*-4 is an example of a first conductive section according to the second embodiment. The wiring 153*a*-2 that electrically couples the liquid ejecting heads 21 to a drive signal output circuit 51*a* is an example of a second wiring according to the second embodiment. The coupling section 180*a*-2 is an example of a second coupling section according to the second embodiment. At least any one of the wiring 153*a*-2, the terminal 152*a*-2, the terminal 343-2, and the coupling section 180*a*-2 is an example of a second conductive section according to the second embodiment. The wiring 153*a*-4 that electrically couples the liquid ejecting heads 21 to a drive signal output circuit 51*c* is an example of a third wiring according to the second embodiment. The coupling section 180*a*-4 is an example of a third coupling section according to the second embodiment. At least any one of the wiring 153*a*-4, the terminal 152*a*-4, the terminal 343-4, and the coupling section 180*a*-4 is an example of a third conductive section according to the second embodiment.

At least any one of the wiring 153*a*-3, the terminal 152*a*-3, the terminal 343-3, and the coupling section 180*a*-3 is an example of a fourth conductive section according to the second embodiment. The wiring 153*a*-3, the terminal 152*a*-3, the terminal 343-3, and the coupling section 180*a*-3 electrically couple a reference voltage output circuit 52 to the second terminals of the piezoelectric elements 60 through which the reference voltage signal VBS1 propagates and that are different from the first terminals of the piezoelectric elements 60 to which the drive signal COMB1 is supplied, and propagate the reference voltage signal VBS1 to the piezoelectric elements 60.

3. Third Embodiment

Next, a liquid ejecting apparatus 1 according to a third embodiment is described. FIG. 19 is a diagram illustrating an example of the allocation of signals that propagate through wirings 153*a*, terminals 343, and coupling sections 180*a* in which terminals 152*a* are coupled to the terminals 343. FIG. 20 is a diagram illustrating an example of the allocation of signals that propagate through wirings 153*b*, terminals 353, and coupling sections 180*b* in which terminals 152*b* are coupled to the terminals 353.

As illustrated in FIGS. 19 and 20, the liquid ejecting apparatus 1 according to the third embodiment is different from the liquid ejecting apparatus 1 according to the second embodiment in that wirings and terminals that are present around wirings and terminals through which a drive signal COMC1 with a small voltage amplitude propagates are at a fixed potential.

Specifically, as illustrated in FIGS. 19 and 20, in the liquid ejecting apparatus 1 according to the third embodiment, a drive signal COMA1 is propagated through a wiring 153*a*-2, a terminal 152*a*-2, a terminal 343-2, a coupling section 180*a*-2, a wiring 153*a*-(*p*-1), a terminal 152*a*-(*p*-1), a terminal 343-(*p*-1), and a coupling section 180*a*-(*p*-1). The wiring 153*a*-(*p*-1), the terminal 152*a*-(*p*-1), the terminal 343-(*p*-1), and the coupling section 180*a*-(*p*-1) are positioned facing the wiring 153*a*-2, the terminal 152*a*-2, the terminal 343-2, and the coupling section 180*a*-2 via an assembly substrate 33, respectively. A reference voltage signal VBS1 is propagated through a wiring 153*a*-3, a terminal 152*a*-3, a terminal 343-3, a coupling section 180*a*-3, a wiring 153*a*-(*p*-2), a terminal 152*a*-(*p*-2), a terminal 343-(*p*-2), and a coupling section 180*a*-(*p*-2) that are positioned adjacent to the wirings and the terminals through which the drive signal COMA1 propagates. In addition, a drive signal COMB1 is propagates through a wiring 153*a*-4, a terminal 152*a*-4, a terminal 343-4, a coupling section 180*a*-4, a wiring 153*a*-(*p*-3), a terminal 152*a*-(*p*-3), a terminal 343-(*p*-3), and a coupling section 180*a*-(*p*-3) that are positioned adjacent to the wirings and the terminals through which the reference voltage signal VBS1 propagates. The drive signal COMC1 propagates through a wiring 153*a*-6, a terminal 152*a*-6, a terminal 343-6, and a coupling section 180*a*-6. Wirings 153*a*-5 and 153*a*-7, terminals 152*a*-5 and 152*a*-7, terminals 343-5 and 343-7, and coupling sections 180*a*-5 and 180*a*-7 propagate a signal at a ground potential that is a fixed potential. The wirings 153*a*-5 and 153*a*-7 are positioned adjacent to the wiring 153*a*-6 through which the drive signal COMC1 propagates. The terminals 152*a*-5 and 152*a*-7 are positioned adjacent to the terminal 152*a*-6 through which the drive signal COMC1 propagates. The terminals 343-5 and 343-7 are positioned adjacent to the terminal 343-6 through which the drive signal COMC1 propagates. The coupling sections 180*a*-5 and 180*a*-7 are positioned adjacent to the coupling section 180*a*-6 through which the drive signal COMC1 propagates.

A cable 15*a* includes the wirings 153*a*-5 and 153*a*-7 and the terminals 152*a*-5 and 152*a*-7 that propagate the signal at the fixed ground potential. The wirings 153*a*-5 and 153*a*-7 are positioned adjacent to the wiring 153*a*-6 through which the drive signal COMC1 propagates. The terminals 152*a*-5 and 152*a*-7 are positioned adjacent to the terminal 152*a*-6 through which the drive signal COMC1 propagates. A coupler 330 has the terminals 343-5 and 343-7 that propagate the signal at the fixed ground potential. The terminals 343-5 and 343-7 are positioned adjacent to the terminal 343-6 through which the drive signal COMC1 propagates.

As illustrated in FIGS. 15 and 16, a wiring 153*b*-(*p*-5) included in a cable 15*b* and positioned facing the wiring 153*a*-5 through which the drive signal COMC1 propagates via the assembly substrate 33 propagates the signal at the fixed ground potential. A terminal 353-(*p*-5) included in a coupler 331 and positioned facing the terminal 343-5 through which the drive signal COMC1 propagates via the assembly substrate 33 propagates the signal at the fixed ground potential. In other words, the wiring 153*a*-5 that propagates the drive signal COMC1 is positioned overlapping, in a direction intersecting a direction in which the terminals 343 of the coupler 330 are arranged side by side, the wiring 153*b*-(*p*-5) that is included in the cable 15*b* and that propagates the signal at the ground potential. The terminal 343-5 that propagates the drive signal COMC1 is positioned overlapping, in the direction intersecting the direction in which the terminals 343 of the coupler 330 are arranged side by side, the terminal 353-(*p*-5) that is included in the coupler 330 and propagates the signal at the ground potential.

In the liquid ejecting apparatus 1 configured as described above, the wirings and the terminals through which the signal at the fixed ground potential propagates surround the wirings and the terminals through which the drive signal COMC1 with the small voltage amplitude propagates. The wirings and the terminals through which the signal at the fixed ground potential propagates function as shield wirings and shield terminals. As a result, a possibility that the drive signal COMA1 may interfere with the drive signal COMC1 with the small voltage amplitude is further reduced.

In the liquid ejecting apparatus 1 according to the third embodiment, all the wirings and the terminals, which surround the wirings and the terminals through which the drive signal COMC1 with the small voltage amplitude propagates, propagate the signal at the ground potential. However, it is sufficient if at least one of the wirings and the terminals that surround the wirings and the terminals through which the drive signal COMC1 with the small voltage amplitude propagates is at the ground potential. In the liquid ejecting apparatus 1 according to the third embodiment, the signal at the fixed potential that propagates through the wirings and the terminals that surround the wirings and the terminals through which the drive signal COMC1 with the small voltage amplitude propagates is the signal at the ground potential. However, the present embodiment is not limited to this. For example, the signal at the fixed potential may be a direct-current voltage signal at a predetermined potential or may be the reference voltage signal VBS1.

The wiring 153*a*-4 that electrically couples liquid ejecting heads 21 to a drive signal output circuit 51*b* is an example of a first wiring according to the third embodiment. The coupling section 180*a*-4 is an example of a first coupling section according to the third embodiment. At least any one of the wiring 153*a*-4, the terminal 152*a*-4, the terminal 343-4, and the coupling section 180*a*-4 is an example of a first conductive section according to the third embodiment. The wiring 153*a*-2 that electrically couples the liquid ejecting heads 21 to a drive signal output circuit 51*a* is an example of a second wiring according to the third embodiment. The coupling section 180*a*-2 is an example of a second coupling section according to the third embodiment. At least any one of the wiring 153*a*-2, the terminal 152*a*-2, the terminal 343-2, and the coupling section 180*a*-2 is an example of a second conductive section according to the third embodiment. The wiring 153*a*-6 that electrically couples the liquid ejecting heads 21 to a drive signal output circuit 51*c* is an example of a third wiring according to the third embodiment. The coupling section 180*a*-6 is an example of a third coupling section according to the third embodiment. At least any one of the wiring 153*a*-6, the terminal 152*a*-6, the terminal 343-6, and the coupling section 180*a*-6 is an example of a third conductive section according to the third embodiment. At least any one of the wiring 153*a*-3, the terminal 152*a*-3, the terminal 343-3, and the coupling section 180*a*-3 is an example of a fourth conductive section according to the third embodiment. The wiring 153*a*-3, the terminal 152*a*-3, the terminal 343-3, and the coupling section 180*a*-3 electrically couple the reference voltage output circuit 52 to second terminals of piezoelectric elements 60 through which the reference voltage signal VBS1 propagates and that are different from first terminals of the piezoelectric elements 60 to which the drive signal COMB1 is supplied, and propagate the reference voltage signal VBS1 to the piezoelectric elements 60. At least any one of the wiring 153*a*-5, the terminal 152*a*-5, the terminal 343-5, and the coupling section 180*a*-5 that propagate the signal at the fixed potential is an example of a fifth conductive section according to the third embodiment. At least any one of the wiring 153*a*-7, the terminal 152*a*-7, the terminal 343-7, and the coupling section 180*a*-7 is an example of a sixth conductive section according to the third embodiment. At least one of the cable 15*a* and the coupler 331 is an example of a second conductive component according to the third embodiment. At least any one of the wiring 153*b*-(*p*-5), the terminal 152*b*-(*p*-5), the terminal 353-(*p*-5), and the coupling section 180*b*-(*p*-5) is an example of a seventh conductive component according to the third embodiment.

Although the embodiments are described above, the present disclosure is not limited to the embodiments and can be achieved in various aspects without departing from the gist of the present disclosure. For example, the foregoing embodiments can be combined.

The present disclosure includes configurations (for example, configurations that include the same functions as described above, perform the same methods as described above, and provide the same results as described above, or configurations whose purposes and effects are the same as described above) that are substantially the same as the configurations described in the embodiments. In addition, the present disclosure includes a configuration with a section with which an inessential section of the configurations described in the embodiments is replaced. Furthermore, the present disclosure includes a configuration that has the same effect as that of the configurations described in the embodiments or a configuration that can achieve the same object as that of the configurations described in the embodiments. The present disclosure includes a configuration obtained by adding a known technique to one or more of the configurations described in the embodiments.

The following details can be derived from the foregoing embodiments.

According to an aspect, a liquid ejecting apparatus includes a liquid ejecting head that includes a piezoelectric element and ejects a liquid, a first drive signal output circuit that outputs a first drive signal to drive the piezoelectric element so as to eject the liquid from the liquid ejecting head, a second drive signal output circuit that outputs a second drive signal to drive the piezoelectric element so as to eject the liquid from the liquid ejecting head, a third drive signal output circuit that outputs a third drive signal, having a smaller voltage amplitude than voltage amplitudes of the first and second drive signals, to drive the piezoelectric element so as not to eject the liquid from the liquid ejecting head, and a first conductive component including a first conductive section that electrically couples the liquid ejecting head to the first drive signal output circuit, a second conductive section that electrically couples the liquid ejecting head to the second drive signal output circuit, and a third conductive section that electrically couples the liquid ejecting head to the third drive signal output circuit, and the first conductive section is positioned between the second conductive section and the third conductive section.

According to the liquid ejecting apparatus, the first conductive section that electrically couples the liquid ejecting head to the first drive signal output circuit and through which the first drive signal to drive the piezoelectric element so as to eject the liquid from the liquid ejecting head propagates is positioned between the second conductive section that electrically couples the liquid ejecting head to the second drive signal output circuit and through which the second drive signal to drive the piezoelectric element so as to eject the liquid from the liquid ejecting head propagates and the third conductive section that electrically couples the liquid ejecting head to the third drive signal output circuit and through which the third drive signal having the smaller voltage amplitude than the voltage amplitudes of the first and second drive signals to drive the piezoelectric element so as to eject the liquid from the liquid ejecting head propagates. Therefore, the third conductive section through which the third drive signal with the small voltage amplitude propagates can be positioned away from the second conductive section through which the second drive signal propagates. As a result, a possibility that the second drive signal may interfere with the third conductive section is reduced and the accuracy of transferring the third drive signal is improved.

According to the aspect, in the liquid ejecting apparatus, the first conductive component may include a fourth conductive section that propagates a signal at a fixed potential, and the fourth conductive section may be positioned adjacent to the first conductive section.

According to the liquid ejecting apparatus, the fourth conductive section at the fixed potential is positioned adjacent to the first conductive section positioned between the third conductive section and the second conductive section. The fourth conductive section is positioned between the third conductive section and the second conductive section. Therefore, the fourth conductive section at the fixed potential functions as a shield member that reduces a possibility that the second drive signal may interfere with the third drive signal. As a result, a possibility that the second drive signal may interfere with the third conductive section is further reduced.

According to the aspect, in the liquid ejecting apparatus, the fourth conductive section may be positioned adjacent to the second conductive section.

According to the liquid ejecting apparatus, the fourth conductive section at the fixed potential is positioned adjacent to the first conductive section and the second conductive section and functions as a shield member that reduces a possibility that the second drive signal may interfere with the third drive signal. As a result, a possibility that the second drive signal may interfere with the third conductive section is further reduced.

According to the aspect, the liquid ejecting apparatus may include a fixed potential signal output circuit that outputs a fixed potential signal at a fixed potential, the fourth conductive section may electrically couple the fixed potential signal output circuit to a second terminal of the piezoelectric element that is different from a first terminal of the piezoelectric element to which the first drive signal is supplied, and the fourth conductive section may propagate the fixed potential signal to the piezoelectric element.

According to the liquid ejecting apparatus, since the fixed potential signal to be supplied to the second terminal of the piezoelectric element propagates through the fourth conductive section, it is possible to reduce an increase in the number of terminals and reduce a possibility that the second drive signal may interfere with the third conductive section. In addition, the fourth conductive section that propagates the fixed potential signal to be supplied to the second embodiment of the piezoelectric element is positioned between the first conductive section that propagates the first drive signal to be supplied to the first terminal of the piezoelectric element and the second conductive section that propagates the second drive signal to be supplied to the first terminal of the piezoelectric element. Therefore, it is possible to reduce an inductance component corresponding to an electric current that occurs when the first drive signal and the second drive signal are supplied to the piezoelectric element. As a result, it is possible to improve the accuracy of the first and second drive signals.

According to the aspect, in the liquid ejecting apparatus, the first conductive component may include a fifth conductive section that propagates a signal at a fixed potential, and the fifth conductive section may be positioned adjacent to the third conductive section.

According to the aspect, in the liquid ejecting apparatus, the first conductive component may include a sixth conductive section that propagates a signal at a fixed potential, and the sixth conductive section may be positioned adjacent to the third conductive section.

According to the aspect, the liquid ejecting apparatus may further include a second conductive component including a seventh conductive section that propagates a signal at a fixed potential, and the seventh conductive section may be positioned overlapping the third conductive section in a direction intersecting a direction in which the first conductive section and the second conductive section are arranged side by side.

According to the liquid ejecting apparatus, since at least any one of the fifth conductive section at the fixed potential, the sixth conductive section at the fixed potential, and the seventh conductive section at the fixed potential is positioned adjacent to the third conductive section through which the third drive signal propagates, it is possible to reduce a possibility that noise or the like may interfere with the third conductive section, and as a result, it is possible to further improve the accuracy of the third drive signal.

According to another aspect, a head driving circuit that drives a piezoelectric element included in a liquid ejecting head that ejects a liquid includes a first drive signal output circuit that outputs a first drive signal to drive the piezoelectric element so as to eject the liquid from the liquid ejecting head, a second drive signal output circuit that outputs a second drive signal to drive the piezoelectric element so as to eject the liquid from the liquid ejecting head, a third drive signal output circuit that outputs a third drive signal, having a smaller voltage amplitude than voltage amplitudes of the first and second drive signals, to drive the piezoelectric element so as not to eject the liquid from the liquid ejecting head, and a first cable including a first wiring that is electrically coupled to the first drive signal output circuit and propagates the first drive signal, a second wiring that is electrically coupled to the second drive signal output circuit and propagates the second drive signal, and a third wiring that is electrically coupled to the third drive signal output circuit and propagates the third drive signal, and the first wiring is positioned between the second wiring and the third wiring.

According to the head driving circuit, a first conductive section through which the first drive signal to drive the piezoelectric element so as to eject the liquid from the liquid ejecting head propagates is positioned between a second conductive section through which the second drive signal to drive the piezoelectric element so as to eject the liquid from the liquid ejecting head propagates and a third conductive section through which the third drive signal having the smaller voltage amplitude than the voltage amplitudes of the first and second drive signals to drive the piezoelectric element so as to eject the liquid from the liquid ejecting head propagates, and thus the third conductive section through which the third drive signal with the small voltage amplitude propagates can be positioned away from the second conductive section through which the second drive signal propagates. As a result, a possibility that the second drive signal may interfere with the third conductive section is reduced and the accuracy of transferring the third drive signal is improved.

According to still another aspect, a liquid ejecting head includes a piezoelectric element, a nozzle that ejects a liquid by driving of the piezoelectric element, and a first coupler to which a first wiring through which a first drive signal to drive the piezoelectric element so as to eject the liquid propagates, a second wiring through which a second drive signal to drive the piezoelectric element so as to eject the liquid propagates, and a third wiring through which a third drive signal, having a smaller voltage amplitude than voltage amplitudes of the first and second drive signals, to drive the piezoelectric element so as not to eject the liquid propagates are attached, and a first coupling section in which the first coupler is electrically coupled to the first wiring is positioned between a second coupling section in which the first coupler is electrically coupled to the second wiring and a third coupling section in which the first coupler is electrically coupled to the third wiring.

According to the liquid ejecting head, the first coupling section through which the first drive signal to drive the piezoelectric element so as to eject the liquid propagates is positioned between the second coupling section through which the second drive signal to drive the piezoelectric element so as to eject the liquid propagates and the third coupling section through which the third drive signal, having the smaller voltage amplitude than the voltage amplitudes of the first and second drive signals, to drive the piezoelectric element so as not to eject the liquid propagates. Therefore, a third conductive section through which the third drive signal with the small voltage amplitude propagates can be positioned away from a second conductive section through which the second drive signal propagates. As a result, a possibility that the second drive signal may interfere with the third conductive section is reduced and the accuracy of transferring the third drive signal is improved.

What is claimed is:

1. A liquid ejecting apparatus comprising:

a liquid ejecting head that includes a piezoelectric element and ejects a liquid;

a first drive signal output circuit that outputs a first drive signal to drive the piezoelectric element so as to eject the liquid from the liquid ejecting head;

a second drive signal output circuit that outputs a second drive signal to drive the piezoelectric element so as to eject the liquid from the liquid ejecting head;

a third drive signal output circuit that outputs a third drive signal, having a smaller voltage amplitude than voltage amplitudes of the first and second drive signals, to drive the piezoelectric element so as not to eject the liquid from the liquid ejecting head; and a first conductive component including a first conductive section that electrically couples the liquid ejecting head to the first drive signal output circuit, a second conductive section that electrically couples the liquid ejecting head to the second drive signal output circuit, and a third conductive section that electrically couples the liquid ejecting head to the third drive signal output circuit, wherein the first conductive section is positioned between the second conductive section and the third conductive section.

2. The liquid ejecting apparatus according to claim 1, wherein the first conductive component includes a fourth conductive section that propagates a signal at a fixed potential, and the fourth conductive section is positioned adjacent to the first conductive section.

3. The liquid ejecting apparatus according to claim 2, wherein the fourth conductive section is positioned adjacent to the second conductive section.

4. The liquid ejecting apparatus according to claim 2, further comprising:

a fixed potential signal output circuit that outputs a fixed potential signal at a fixed potential, wherein the fourth conductive section electrically couples the fixed potential signal output circuit to a second terminal of the piezoelectric element that is different from a first terminal of the piezoelectric element to which the first drive signal is supplied, and the fourth conductive section propagates the fixed potential signal to the piezoelectric element.

5. The liquid ejecting apparatus according to claim 1, wherein the first conductive component includes a fifth conductive section that propagates a signal at a fixed potential, and the fifth conductive section is positioned adjacent to the third conductive section.

6. The liquid ejecting apparatus according to claim 5, wherein the first conductive component includes a sixth conductive section that propagates a signal at a fixed potential, and the sixth conductive section is positioned adjacent to the third conductive section.

7. The liquid ejecting apparatus according to claim 1, further comprising:

a second conductive component including a seventh conductive section that propagates a signal at a fixed potential, wherein the seventh conductive section is positioned overlapping the third conductive section in a direction in which the first conductive section and the second conductive section are arranged side by side.

8. A head driving circuit that drives a piezoelectric element included in a liquid ejecting head that ejects a liquid, the head driving circuit comprising:

a first drive signal output circuit that outputs a first drive signal to drive the piezoelectric element so as to eject the liquid from the liquid ejecting head;

a second drive signal output circuit that outputs a second drive signal to drive the piezoelectric element so as to eject the liquid from the liquid ejecting head;

a third drive signal output circuit that outputs a third drive signal, having a smaller voltage amplitude than voltage amplitudes of the first and second drive signals, to drive the piezoelectric element so as not to eject the liquid from the liquid ejecting head; and a first cable including a first wiring that is electrically coupled to the first drive signal output circuit and propagates the first drive signal, a second wiring that is electrically coupled to the second drive signal output circuit and propagates the second drive signal, and a third wiring that is electrically coupled to the third drive signal output circuit and propagates the third drive signal, wherein the first wiring is positioned between the second wiring and the third wiring.

* * * * *